US005349130A

United States Patent [19]

Iwaooji

[11] Patent Number: 5,349,130

[45] Date of Patent: Sep. 20, 1994

[54] PITCH EXTRACTING APPARATUS HAVING MEANS FOR MEASURING INTERVAL BETWEEN ZERO-CROSSING POINTS OF A WAVEFORM

[75] Inventor: Makoto Iwaooji, Hamura, Japan

[73] Assignee: Casio Computer Co., Ltd., Tokyo, Japan

[21] Appl. No.: 154,157

[22] Filed: Nov. 17, 1993

Related U.S. Application Data

[63] Continuation of Ser. No. 874,813, Apr. 28, 1992, abandoned.

[30] Foreign Application Priority Data

| | | | |
|---|---|---|---|
| May 2, 1991 | [JP] | Japan | 3-100803 |
| May 2, 1991 | [JP] | Japan | 3-100985 |
| May 2, 1991 | [JP] | Japan | 3-100986 |
| May 24, 1991 | [JP] | Japan | 3-120291 |

[51] Int. Cl.[5] ..... G10H 7/02

[52] U.S. Cl. ..... 84/616; 84/654; 84/454; 84/DIG. 18

[58] Field of Search ..... 84/616, 654, 681, 454, 84/DIG. 18; 324/76.47; 381/38, 49

[56] References Cited

U.S. PATENT DOCUMENTS

| | | | |
|---|---|---|---|
| 4,429,609 | 2/1984 | Warrender | 84/454 |
| 4,633,748 | 1/1987 | Takashima et al. . | |
| 4,688,464 | 8/1987 | Gibson et al. . | |
| 5,018,428 | 5/1991 | Uchiyama et al. . | |

*Primary Examiner*—Stanley J. Witkowski

*Attorney, Agent, or Firm*—Frishauf, Holtz, Goodman & Woodward

[57] ABSTRACT

A CPU measures the interval between the zero-crossing points at the two ends of a waveform element a having, e.g., a positive polarity. Thereafter, the CPU sequentially measures the interval between the zero-crossing points at the two ends of each of waveform elements b, c, and d having the same polarity. Upon detection of the waveform element d which is almost equal in interval to the waveform element a and is located nearest thereto in terms of time, the interval between the start points (zero-crossing points) of the waveform elements a and d is extracted as the pitch period of the input waveform. Subsequently, the above-described series of operations is repeated.

16 Claims, 12 Drawing Sheets

PITCH EXTRACTING APPARATUS HAVING MEANS FOR MEASURING INTERVAL BETWEEN ZERO-CROSSING POINTS OF A WAVEFORM

This application is a continuation of U.S. patent application Ser. No. 07/874,813, filed Apr. 28, 1992 and now abandoned.

BACKGROUND OF THE INVENTION

1. Field of the Invention

The present invention relates to a pitch extracting apparatus for extracting a pitch (tone pitch) of the waveform of an input waveform signal.

2. Description of the Related Art

There have been strong demands for extraction of a pitch frequency or pitch period (to be simply referred to as a pitch hereinafter) of a musical tone signal consisting of a repetitive waveform, e.g., a singing voice of a person or a musical tone picked up by a microphone. If a pitch can be extracted, the extracted pitch data can be used for various types of processing. For example, a musical tone corresponding to the pitch (tone pitch) can be generated by an electronic musical instrument or the like.

Various methods have been proposed to extract pitches from audio signals. Of such conventional methods, a method of directly extracting a pitch from an audio signal in a time zone requires only a small amount of arithmetic operations and hence easily allows real-time processing.

According to a first conventional method of extracting a pitch in a time zone, the time interval between adjacent zero-crossing points (time positions at which the amplitude becomes zero) of an input waveform is obtained as the pitch period of the waveform.

According to a second conventional method, a zero-crossing interval is extracted after an input waveform is filtered by a low-pass filter to remove its harmonic components (see, e.g., U.S. Pat. No. 4,688,464 and U.S. Pat. No. 5,018,428).

In addition, according to a third conventional method, the auto-correlation values of an input waveform are calculated, and a pitch period is extracted on the basis of an auto-correlation deviation as a peak value (see, e.g., U.S. Pat. No. 4,633,748).

A human voice, however, contains a considerable amount of harmonic components, and hence a zero-crossing point appears several times within one pitch period of an input waveform. For this reason, if a zero-crossing interval is simply extracted as in the first conventional method, a correct period cannot be obtained, resulting in a large pitch extraction error.

In the second conventional method, if the cutoff frequency of the low-pass filter is decreased, the range in which a pitch can be extracted is limited to a small range of pitch. In contrast to this, if the cutoff frequency is increased, harmonic components are left to increase the pitch extraction error.

Furthermore, in the third conventional method, an enormous amount of arithmetic operations is required in spite of processing in a time zone. If, therefore, arithmetic operations are to be executed with high precision, the pitch of an input waveform cannot be extracted in real-time.

SUMMARY OF THE INVENTION

It is an object of the present invention to eliminate the influence of zero crossing caused by harmonic components described above, thereby allowing correct measurement of the zero-crossing interval, of an input waveform, which corresponds to one pitch period.

According to an arrangement of the present invention, an apparatus includes first interval measuring means for measuring an interval, as a first interval, between a zero-crossing point, at which an input waveform changes from a negative or positive first polarity to a second polarity, and a next zero-crossing point at which the input waveform changes from the second polarity to the first polarity.

The apparatus further includes second interval measuring means for, after measurement by the first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity.

The apparatus further includes third interval measuring means for sequentially measuring intervals between the zero-crossing point at which measurement by the first interval measuring means is started and predetermined respective points of time.

For example, the first, second, and third interval measuring means are constituted by counters.

The apparatus further includes interval storage means for sequentially updating and storing the intervals, as period data, which are measured by the third interval measuring means at the respective points of time at which the second interval measuring means starts measuring the respective second intervals.

The apparatus further includes determining means for sequentially checking whether the first interval measured by the first interval measuring means is nearly equal to the respective second intervals sequentially measured by the second interval measuring means within a predetermined tolerance range.

The apparatus further includes repetitive control means for outputting the period data stored in the interval storage means as pitch data of the input waveform at a point of time at which the determining means detects the coincidence, and sequentially extracting pitch data from the input data by sequentially repeating each processing from the measurement by the first interval measuring means.

According to the above-described arrangement of the present invention, the apparatus can be designed to have control means for checking whether the interval measured by the third interval measuring means exceeds an interval corresponding to a pitch period of a predetermined lowest tone at a point of time at which the equality is not detected by the determining means, and for repeating each processing from the measurement by the first interval measuring means if it is determined that the interval exceeds the pitch period.

A voice or speech signal is formed as a waveform having one or more peaks repeatedly appearing at every pitch period. The waveforms in consecutive pitch periods are similar in shape to each other. The intervals between the start and end zero-crossing points of substantially similar waveform elements in adjacent pitch periods are substantially equal to each other.

According to the present invention, in consideration of such characteristics, the first interval measuring means measures the interval between the zero-crossing points at the two ends of one waveform element, and the second interval measuring means subsequently measures the interval between the zero-crossing points at the two ends of each of subsequent waveform elements.

The determining means sequentially checks equality between the first interval and each second interval within the predetermined tolerance range, and extracts the interval between the start point of the waveform element corresponding to the first interval and the start point of the waveform element corresponding to the second interval at the point of time at which the equality is detected, as pitch data. This pitch data can be obtained as period data equivalent to each interval measured by the third measuring means and stored in the interval storage means.

With this operation, the pitch of an input waveform can be stably extracted regardless of the influence of harmonic components.

According to another arrangement of the present invention, an apparatus includes first interval measuring means for measuring an interval, as a first interval, between a zero-crossing point, at which an input waveform changes from a negative or positive first polarity to a second polarity, and a next zero-crossing point at which the input waveform changes from the second polarity to the first polarity.

The apparatus further includes first accumulated amplitude value measuring means for measuring an accumulated value of absolute amplitude values of the input waveform, as a first accumulated amplitude value, while the first interval measuring means is measuring the first interval.

The apparatus further includes second interval measuring means for, after measurement by the first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity.

The apparatus further includes second accumulated amplitude value measuring means for sequentially measuring accumulated values of absolute amplitude values of the input waveform, as a second accumulated amplitude value, in the respective intervals in which the second interval measuring means sequentially measures the respective second intervals.

The apparatus further includes third interval measuring means for sequentially measuring intervals between the zero-crossing point at which measurement by the first interval measuring means is started and predetermined respective points of time.

For example, the first, second, and third interval measuring means comprise by counters.

The apparatus further includes interval storage means for sequentially updating and storing the intervals, as period data, which are measured by the third interval measuring means at the respective points of time at which the second interval measuring means starts measuring the respective second intervals.

The apparatus further includes determining means for sequentially checking whether the first interval measured by the first interval measuring means is nearly equal to the respective second intervals sequentially measured by the second interval measuring means within a predetermined tolerance range, and sequentially checking whether the first accumulated amplitude value measured by the first accumulated amplitude value measuring means is nearly equal to the respective second accumulated amplitude values sequentially measured by the second accumulated amplitude value measuring means within a predetermined tolerance range.

The apparatus further includes repetitive control means for outputting the period data stored in the interval storage means as pitch data of the input waveform at a point of time at which the determining means detects the equality, and sequentially extracting pitch data from the input data by sequentially repeating each processing from the measurement by the first interval measuring means.

According to the above-described arrangement of the present invention, the apparatus can be designed to have control means for checking whether the interval measured by the third interval measuring means exceeds an interval corresponding to a pitch period of a predetermined lowest tone at a point of time at which the equality is not detected by the determining means, and for repeating each processing from the measurement by the first interval measuring means if it is determined that the interval exceeds the pitch period.

A voice signal is formed as a waveform having one or more peaks repeatedly appearing at every pitch period. The waveforms in consecutive pitch periods are similar in shape to each other. The intervals between the start and end zero-crossing points of substantially similar waveform elements and areas of the elements in adjacent pitch periods are substantially equal to each other.

According to the present invention, in consideration of such characteristics, the first interval measuring means measures the interval between the zero-crossing points at the two ends of one waveform element, and the first accumulated amplitude value measuring means measures a first accumulated amplitude value corresponding to the area of the waveform element. The second interval measuring means subsequently measures the interval between the zero-crossing points at the two ends of each of subsequent waveform elements, and the second accumulated amplitude value measuring means measures a second accumulated amplitude value corresponding to the area of each waveform element.

The determining means sequentially checks equality between the first interval and each second interval within the predetermined tolerance range, and between the first accumulated amplitude value and each second accumulated amplitude value with the predetermined tolerance range, and extracts the interval between the start point of the waveform element corresponding to the first interval and the start point of the waveform element corresponding to the second interval at the point of time at which the equality is detected, as pitch data. This pitch data can be obtained as period data equivalent to each interval measured by the third measuring means and stored in the interval storage means.

With this operation, the pitch of an input waveform can be stably extracted regardless of the influence of harmonic components.

According to still another arrangement of the present invention, an apparatus includes first interval measuring means for measuring an interval, as a first interval, between a zero-crossing point, at which an input waveform changes from a negative or positive first polarity to a second polarity, and a next zero-crossing point at which the input waveform changes from the second polarity to the first polarity.

The apparatus further includes first maximum amplitude value measuring means for measuring an absolute maximum amplitude value of the input waveform, as a first maximum amplitude value, while said first interval measuring means is measuring the first interval.

The apparatus further includes second interval measuring means for, after measurement by the first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity.

The apparatus further includes second maximum amplitude value measuring means for sequentially measuring maximum values of absolute amplitude values of the input waveform, as a second maximum amplitude value, in the respective intervals in which the second interval measuring means sequentially measures the respective second intervals.

The apparatus further includes third interval measuring means for sequentially measuring intervals from the zero-crossing point at which measurement by the first interval measuring means is started to a predetermined point of time.

For example, the first, second, and third interval measuring means comprise by counters.

The apparatus further includes interval storage means for sequentially updating and storing the intervals, as period data, which are measured by the third interval measuring means at the respective points of time at which the second interval measuring means starts measuring the respective second intervals.

The apparatus further includes determining means for sequentially checking whether the first interval measured by the first interval measuring means is nearly equal to the respective second intervals sequentially measured by the second interval measuring means within a predetermined tolerance range, and sequentially checking whether the first maximum amplitude value measured by the first maximum amplitude value measuring means is nearly equal to the respective second maximum amplitude values sequentially measured by the second maximum amplitude value measuring means within a predetermined tolerance range.

The apparatus further includes repetitive control means for outputting the period data stored in the interval storage means as pitch data of the input waveform at a point of time at which the determining means detects the equality, and sequentially extracting pitch data from the input data by sequentially repeating each processing from the measurement by the first interval measuring means.

According to the above-described arrangement of the present invention, the apparatus can be designed to have control means for checking whether the interval measured by the third interval measuring means exceeds an interval corresponding to a pitch period of a predetermined lowest tone at a point of time at which the equality is not detected by the determining means, and for repeating each processing from the measurement by the first interval measuring means if it is determined that the interval exceeds the pitch period.

A voice signal is formed as a waveform having one or more peaks repeatedly appearing at every pitch period. The waveforms in consecutive pitch periods are similar in shape to each other. The intervals between the start and end zero-crossing points of substantially similar waveform elements and peak values of the elements in adjacent pitch periods are substantially equal to each other.

According to the present invention, in consideration of such characteristics, the first interval measuring means measures the interval between the zero-crossing points at the two ends of one waveform element, and the first maximum amplitude value measuring means measures a first maximum amplitude value corresponding to the peak value of the waveform element. The second interval measuring means subsequently measures the interval between the zero-crossing points at the two ends of each of subsequent waveform elements, and the second maximum amplitude value measuring means measures a second maximum amplitude value corresponding to the peak value of each waveform element.

The determining means sequentially checks equality between the first interval and each second interval within the predetermined tolerance range, and between the first maximum amplitude value and each second maximum amplitude value with the predetermined tolerance range, and extracts the interval between the start point of the waveform element corresponding to the first interval and the start point of the waveform element corresponding to the second interval at the point of time at which the equality is detected, as pitch data. This pitch data can be obtained as period data equivalent to each interval measured by the third measuring means and stored in the interval storage means.

With this operation, the pitch of an input waveform can be stably extracted regardless of the influence of harmonic components.

It is obvious for those who are skilled in the art from the following description of the embodiment that the present invention may adopt other arrangements, modifications, and applications.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

Other objects and arrangements of the present invention will be understood by a person skilled in the art by describing the preferred embodiments of the invention with reference to the accompanying drawings, in which.

DETAILED DESCRIPTION OF THE PREFERRED EMBODIMENTS

First Embodiment

The first embodiment of the present invention will be described below with reference to the accompanying drawings.

Figure 1:
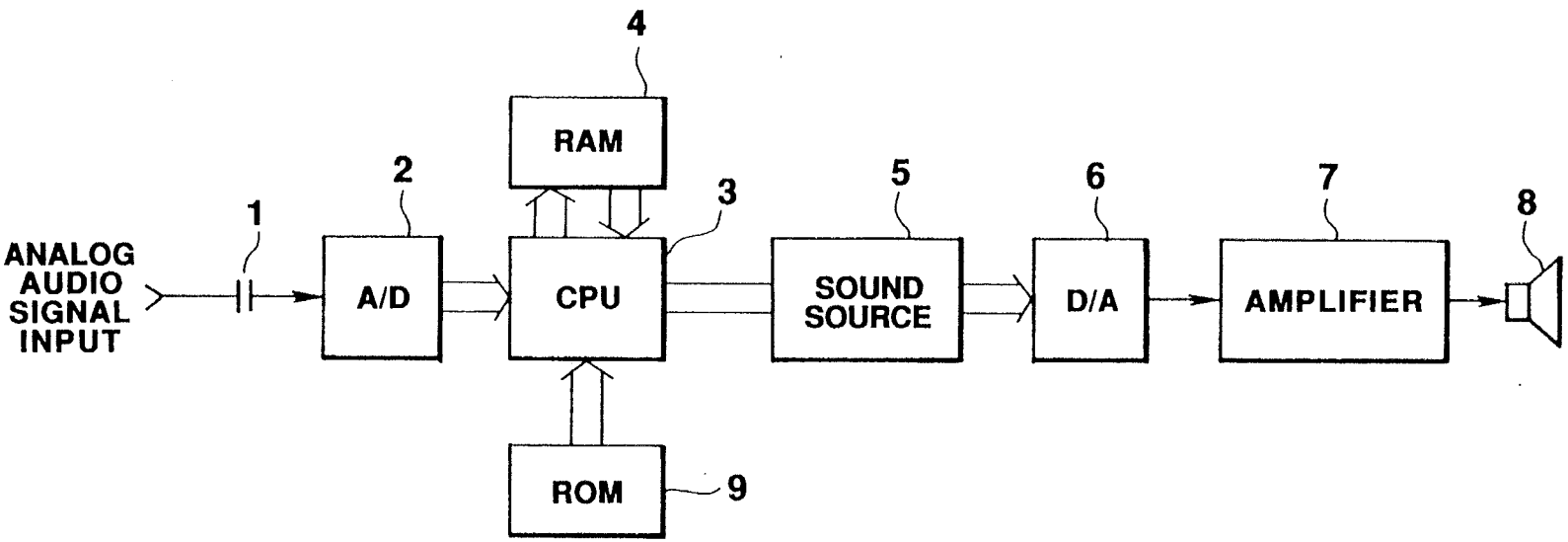
FIG. 1 is a block diagram showing the overall arrangement of an embodiment of the present invention.

FIG. 1 shows the overall arrangement of the first embodiment of the present invention.

Referring to FIG. 1, an analog audio signal such as a singing voice produced by one person or a monophonic sound generated by an analog musical instrument is picked up by a microphone (not shown) and is input to an A/D converter 2 through a capacitor 1 for removing DC components. The analog signal is converted into a digital signal by the A/D converter 2.

A CPU (Central Processing Unit) 3 executes programs stored in a ROM (Read Only Memory) 9 by using a RAM (Random Access Memory) 4, thus extracting tone pitch (pitch) data of the input voice signal.

Subsequently, a sound source 5 generates a musical tone having a note number, based on the tone pitch data, and a tone color (e.g., the tone color of a brass musical instrument such as a trumpet, which is totally different from the singing voice) selected by a performer through a tone color selection switch provided on a Keyboard (not shown). Thereafter, the generated musical tone signal is converted into an analog musical tone signal by a D/A converter 6. The signal is output, as a musical tone, from a speaker 8 through an amplifier 7.

Note that, in addition to the above-mentioned programs, the ROM 9 stores various data used for pitch extraction processing, a table indicating the correspondence between the periods of obtained input signals and note numbers, and the like, as will be described later.

With the above-described circuit arrangement, pitch data (to be referred to as a pitch) is extracted from an input voice signal according to the basic operation principle described below.

Basic operational principle of first embodiment

Figure 2:
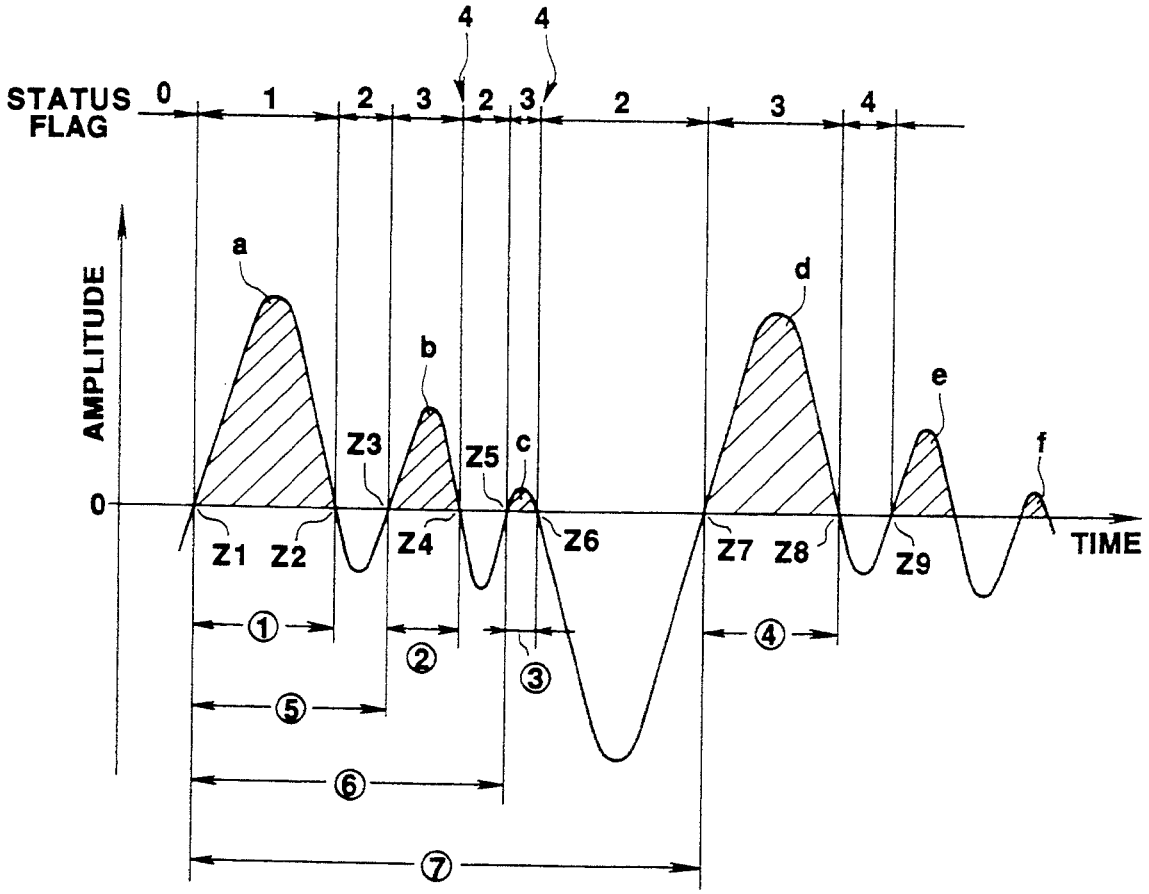
FIG. 2 is a graph showing the waveform of an input waveform signal supplied to the embodiment in FIG. 1.

A waveform of a voice produced as a monophonic sound with distinctive pitches, such as a singing voice produced by a person, is generally constituted by substantially similar waveform elements (e.g., a and d, b and e, and c and f in FIG. 2) repeated at a pitch period (e.g., ⑦), as shown in FIG. 2.

Such a voice waveform contains harmonic components and hence has a large number of zero-crossing points, within one pitch period, at which the waveform crosses the zero-amplitude reference level from negative to positive or positive to negative polarities. For this reason, in order to obtain a pitch period from a waveform having such period characteristics, the interval between specific zero-crossing points must be set as the pitch period. A waveform having the above-described period characteristics has the following characteristic feature.

The time intervals (e.g., ① and ④) determined by zero-crossing points (e.g., Z1 and Z2, and Z7 and Z8) of substantially similar waveform elements (e.g., a and b) in adjacent pitch periods are substantially the same.

In consideration of this point, according to the present invention, two substantially equal time intervals (e.g., ① and ④), each defined by adjacent zero-crossing points, are detected, and the time interval between the start points (e.g., Z1 and Z7) of the two intervals is extracted as a pitch period.

An operation of this embodiment based on the above-described basic operational principle will be described below.

Outline of embodiment

Referring to FIG. 2, for example, the duration of an interval ① between zero-crossing points Z1 and Z2 of a waveform element a is counted, and a count value COUNT1 is held in a first counter. Thereafter, the durations of intervals ②, ③, ④, . . . of waveform elements b, c, d, . . . having the same polarity as that of the waveform element a are sequentially counted, and a count value is sequentially updated and held in a second counter until almost the same value as the count value COUNT1 is obtained.

In this case durations ⑤, ⑥, and ⑦ between the zero-crossing point Z1 and zero-crossing points Z3, Z5, and Z7 of the waveform elements b, c, and d are counted by a third counter. A count value COUNT3 obtained in this operation may be set as the pitch period of this input voice signal. Therefore, the count value COUNT3 is sequentially updated and stored in a variable PIT COUNTER in the RAM 4 until a count value as a pitch period is obtained.

If the interval ④ having almost the same duration as that of the interval ① is found, the count value corresponding to the duration ⑦ between the zero-crossing points Z1 and Z7 is read out from the memory variable PIT COUNTER and is confirmed as a pitch period. A note number corresponding to the pitch period is obtained from the table in the ROM 9 using the count value as address data.

Operation of embodiment

A process of obtaining the pitch of an input waveform in accordance with the above-described operation principle will be described below with reference to the flow charts shown in FIGS. 3A to 5. These flow charts are realized as operations of the CPU 3 executing the control programs stored in the ROM 9.

Figure 3A:
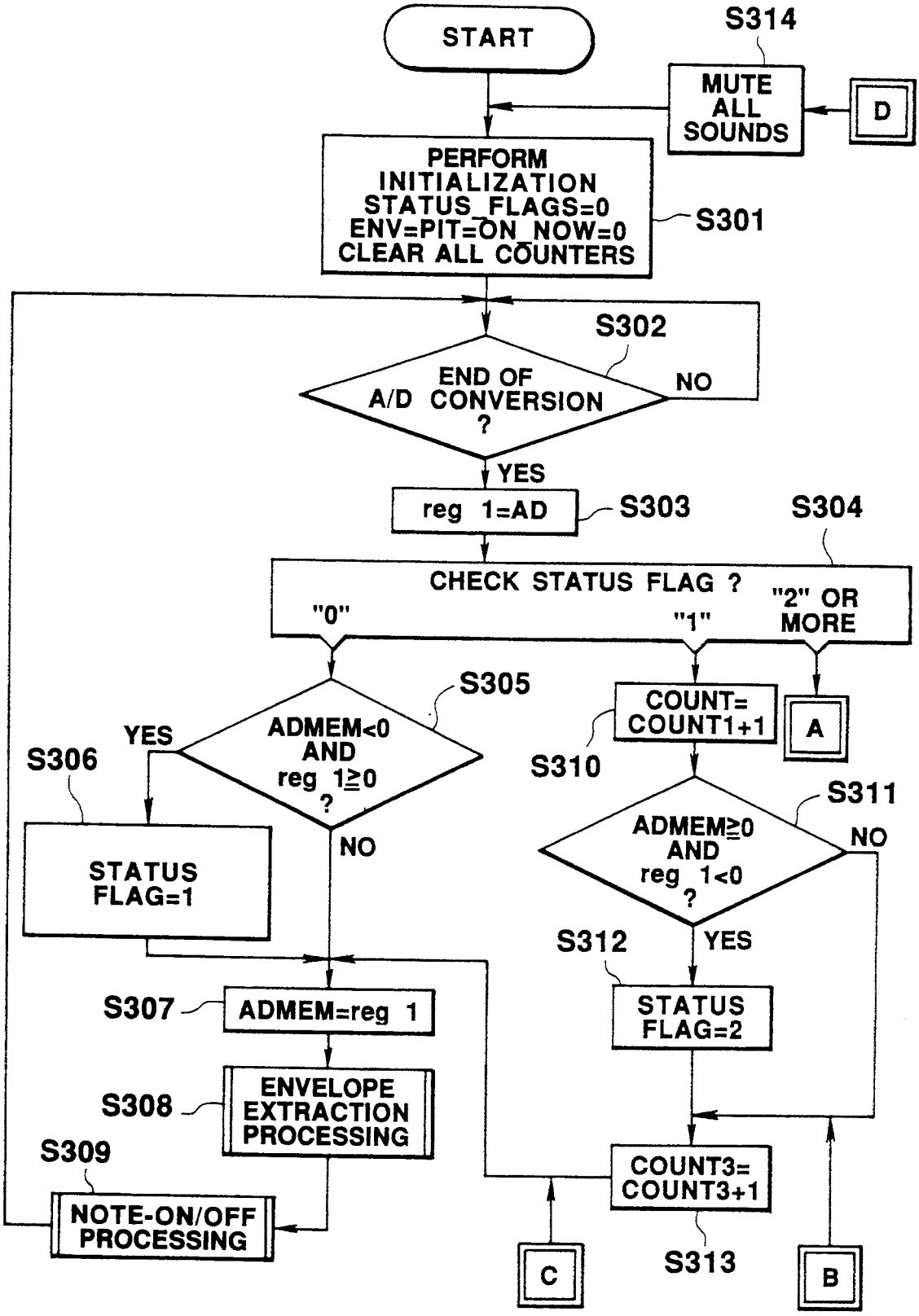
FIGS. 3A and 3B are flow charts showing a series of operations of a CPU 3 in the embodiment in FIG. 1.

Referring to FIG. 3A, the RAM 4 is initialized. That is, the following contents of the RAM 4 are all cleared (step S301): a status flag STATUS FLAG (see FIG. 2) representing that the point of time at which a voice signal is read out corresponds to a specific status of the signal waveform; a variable ENV indicating the magnitude of the envelope of the waveform of the input voice signal; a variable PIT representing a note number corresponding to a pitch obtained by pitch extraction processing; a variable ON NOW representing a note number corresponding to a musical tone currently produced; the variables COUNT1, COUNT2, and COUNT3 respectively representing the count values of the first, second, and third counters; and a variable ADMEM representing an A/D-converted value one sampling operation ahead of the current A/D-converted value. Note that if the value of the variable PIT or ON NOW is "0", it indicates that no sound is pitch-extracted or no sound is currently produced.

When A/D conversion corresponding to one sampling operation of the input voice signal is completed (step S302), the flow advances to step S303 to set the A/D-converted data in a register reg1 in the CPU 3.

Subsequently, the flow is branched to one of three paths depending on the status flag STATUS FLAG (step S304). Since the status flag STATUS FLAG in FIG. 2 is "0" at first, the flow advances to step S305. In the state of STATUS FLAG=0, in order to detect the zero-crossing point zl through which the input waveform extends from the negative side to the positive side, it is checked whether the value of the variable ADMEM representing the A/D-converted value one sampling operation ahead of the current A/D-converted value is negative, and the value of the register reg1 in which the current A/D-converted value is positive.

In this case, NO is obtained in step S305, and the flow advances to step S307.

Subsequently, the value of the register reg1 in which the current A/D-converted value is shifted to be set as the variable ADMEM (step S307). The flow advances to the envelope extraction step (step S308) and the note-ON/OFF (musical tone) processing step (sound production/mute processing; step S309), and waits for the end of A/D conversion again (step S302).

Figure 4:
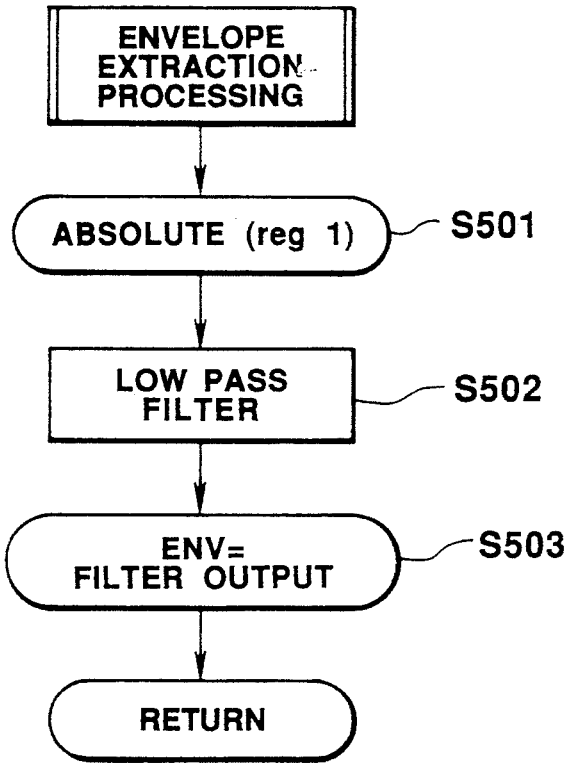
FIG. 4 is a flow chart showing an envelope extraction routine in FIG. 3A in detail.
Figure 5:
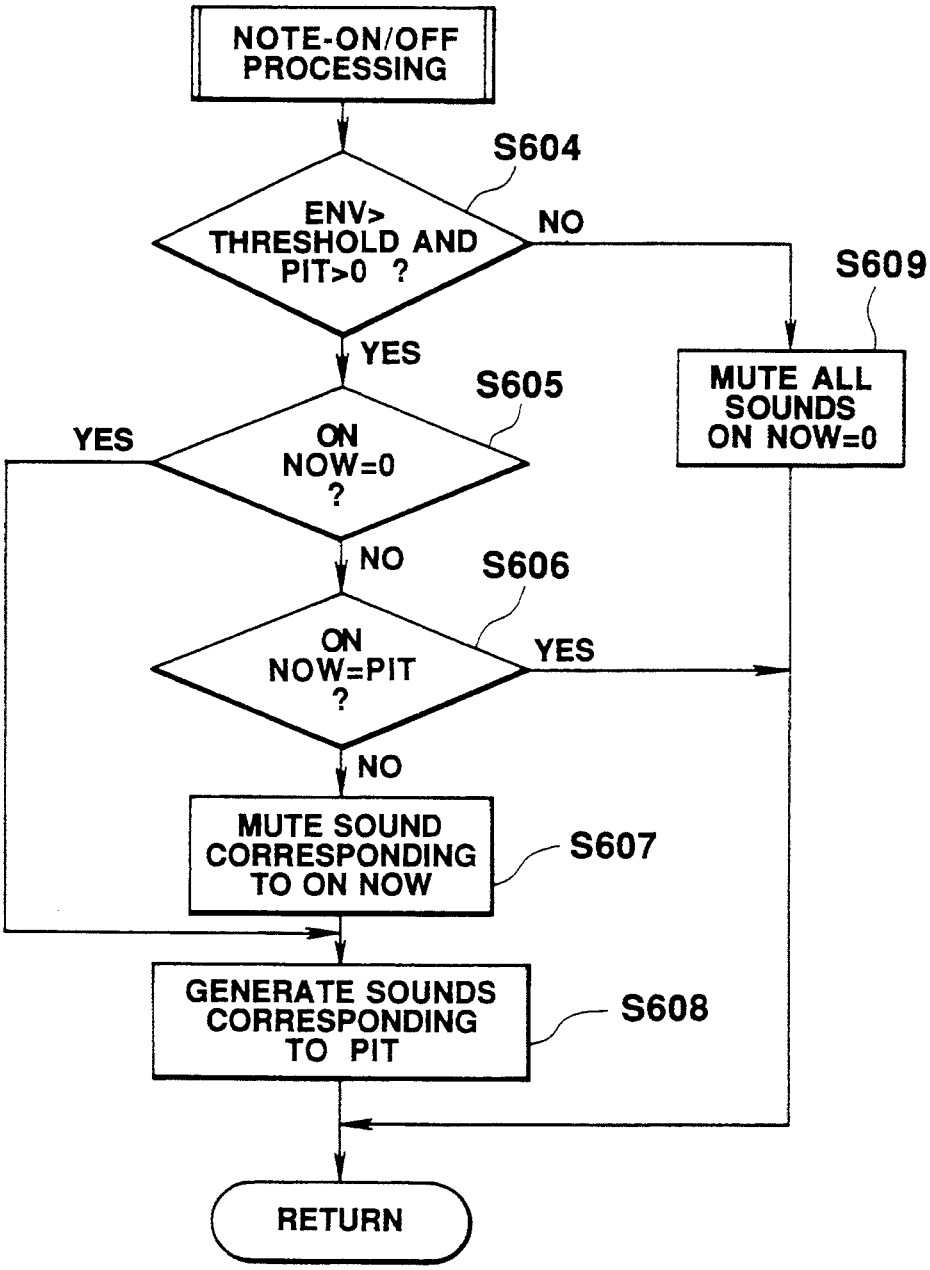
FIG. 5 is a flow chart showing a note-ON/OFF routine in FIG. 3A in detail.

The envelope extraction processing (step S308) and the note-ON/OFF processing for musical tones (step S309) are respectively shown in the flow charts in FIGS. 4 and 5.

Referring to FIG. 4, the absolute value of the current A/D-converted value (the contents of the register reg1) is calculated (step S501). The resulting value is filtered by a low-pass filter (execution of digital filtering processing). Consequently, the input waveform is shaped (step S502). The resultant value is stored as the variable ENV (step S503).

In the note-ON/OFF processing shown in FIG. 5, it is checked first whether the magnitude of the variable ENV exceeds a predetermined threshold value (THRESHOLD), and the value of the variable PIT representing a note number is larger than "0" (step S604).

Figure 3B:
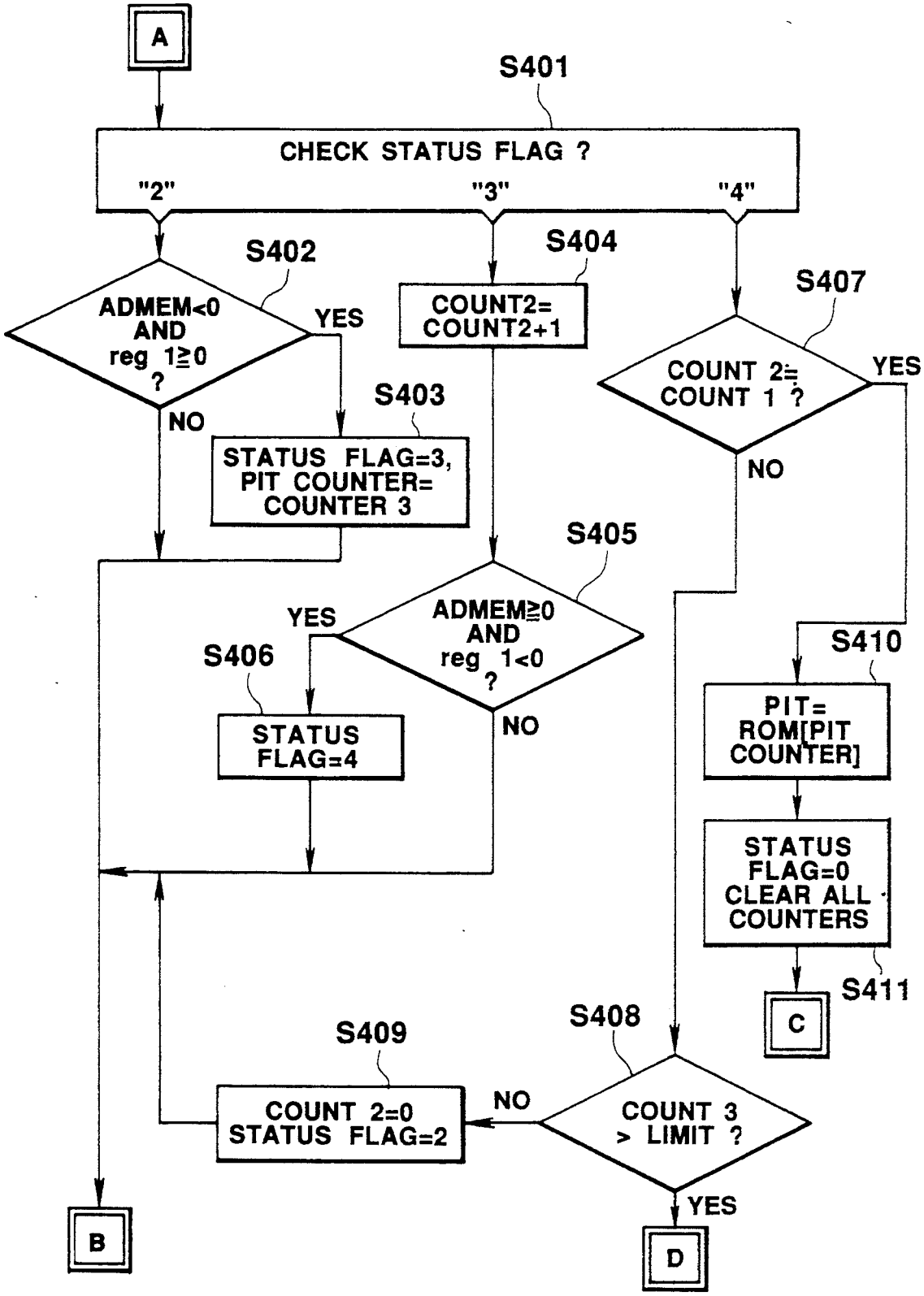

If NO in step S604, muting of all the sounds currently produced by the sound source 5 in FIG. 1 is designated, and the variable ON NOW is cleared to indicate that no sounds are currently produced (step S609). The flow then returns to the main routine (FIGS. 3A and 3B).

If YES in step S604, it is checked in step S605 whether there is any currently produced sound. If YES in step S605, the flow advances to step S608.

If NO in step S605, the value of the variable ON NOW representing the note number of a currently produced musical tone is compared with the value of the variable PIT representing a note number corresponding to an extracted pitch (step S606). If the two variables coincide with each other, since it means that no sound needs to be produced, the flow returns to the main routine (FIGS. 3A and 3B). If they do not coincide with each other, since it means that the note number of a musical tone to be produced is changed, muting of the currently produced sound is designated with respect to the sound source 5 (step S607). Thereafter, the flow advances to step S608.

In step S608, sound production corresponding to the variable PIT representing a note number is designated, and the value of the variable PIT is set as the variable ON NOW to indicate that a musical tone having a pitch corresponding to the variable PIT is currently produced (step S608). Subsequently, the flow returns to the main routine (FIGS. 3A and 3B).

The above-described processing is repeated until the waveform reaches a zero-crossing point (Zl in FIG. 2) through which the waveform extends from the negative side to the positive side. Eventually, YES is obtained in step S305 in FIG. 3A, and the status flag STATUS FLAG is set at "1" (step S306).

After this step, the same operations as described above are performed, and the flow returns to step S304. Since STATUS FLAG=1 is set in this case, the flow advances to step S310. In this state, an increment operation of the variable COUNT1 as the first counter (to be referred to as a first counter COUNT1 hereinafter) for counting the duration of the interval ① in FIG. 2 is started. In addition an increment operation of the variable COUNT3 as the third counter (to be referred to as a third counter COUNT3 hereinafter) for counting the duration of the interval ⑦ is started.

In step S310, the value of the first counter COUNTER1 is incremented by one.

Subsequently, in order to detect a zero-crossing point through which the input waveform extends from the positive side to the negative side, i.e., the zero-crossing point Z2 as the end point of the interval ① in FIG. 2, it is checked whether the value of the variable ADMEM representing the A/D-converted value one sampling operation ahead of the current A/D-converted value is positive, and the value of the register reg1 in which the current A/D-converted value is written is negative (step S311).

If NO in step S311, the value of the third counter COUNT3 is incremented by one (step S313).

Subsequently, loop processing of (steps) S311 →S313 →S307 →S308 →S309 →S302, . . . →S304 . . . . →S311, . . . is repeated, and the first counter COUNT1 and the third counter COUNT3 are incremented by one every time the loop processing is repeated.

If YES is obtained in step S311, and the input waveform reaches the zero-crossing point Z2 through which the waveform extends from the positive side to the negative side, the status flag STATUS FLAG is set at "2" (step S312). The flow then advances to step S313 to increment the value of the third counter COUNT3 by one. Thereafter, the flow advances to steps S307, S308, and S309 in this order, and returns to step S302. With the above-described loop processing, the count value corresponding to the duration of the interval ① is stored in the first counter COUNT1.

Since STATUS FLAG =2 is set in step S312, the flow advances to steps S302 to S304 and further advances to steps S401 and S402 in FIG. 3B.

In step S402, in order to detect a zero-crossing point (Z3 in FIG. 3B) through which the input waveform extends from the negative side to the positive side, the same processing as that in step S305 in FIG. 3A is performed, i.e., it is checked whether the value of the variable ADMEM (the A/D-converted value one sampling operation ahead of the current A/D-converted value) is negative, and the value of the register reg1 (the current A/D-converted value) is positive.

While NO is obtained in step 402, loop processing of S402 →S313 (FIG. 3A) →S307, . . . →S309 →S302 . . . . →S304 →S401 (FIG. 3B) S402, . . . is repeated, and the count value of the third counter COUNT3 is incremented by one every time the loop processing is repeated (step S313).

If YES is obtained in step S402, and the input waveform reaches the zero-crossing point Z3 through which the waveform extends from the negative side to the positive side, the status flag STATUS FLAG is set at "3", and the value of the counter COUNT3 (corresponding to the duration (5) in FIG. 2) is stored as the variable PIT COUNTER (step S403). This PIT COUNTER value is stored as a candidate for a period corresponding to a pitch to be extracted, i.e., a value may become a count value corresponding to the interval (7) in FIG. 2.

Subsequently, the flow advances from step S403 to step S313 (FIG. 3A), . . . , step S309, . . . , step S302, . . . , step S304, and step S401 (FIG. 3B) in this order.

Since STATUS FLAG=3 is set in this case, the flow advances from step S401 to step S404 to increment the count value of the second counter COUNT2 by one. From this point of time, counting of the duration of the interval (2) in FIG. 2 is started.

In order to detect a zero-crossing point through which the input waveform extends from the positive side to the negative side, i.e., the zero-crossing point Z4 corresponding to the end point of the interval (2) in FIG. 2, it is checked whether the value of the variable ADEM (the A/D-converted value one sampling operation ahead of the current A/D-converted value) is positive, and the value of the register reg1 (the current A/D-converted value) is negative (step S405).

If NO in step S405, loop processing of (steps) S404 →S405 →S313 (FIG. 3A), . . . →S309 →S302, . . . →S304 →S401 (FIG. 3B) →S404 is repeated. The second counter COUNT2 and the third counter COUNT3 are incremented by one every time the loop processing is repeated.

If YES in step S405, it means that the zero-crossing point Z4 is detected, and hence the status flag STATUS FLAG is changed to "4" (step S406). The flow then advances to step S313 in FIG. 3A to increment the third counter COUNT3 by one. Subsequently, the flow advances to (steps) S307 →S308 →S309, . . . →S401 (FIG. 3B).

In this case, since the status flag STATUS FLAG=4, the flow advances from step S401 to step S407. In this state, when the intervals (2), (3), and (4) are sequentially compared with the interval (1), and it is determined that the interval (4) has substantially the same duration as that of the interval (1), processing is performed to set the duration of the interval (7) as the pitch period of the input waveform.

It is checked first whether the value of the first counter COUNT1 is substantially equal to that of the second counter COUNT2, i.e., whether the absolute value of the difference between the values of first and second counters COUNT1 and CPOUNT2 falls within a tolerance range (step S407). Although this tolerance range is dependent on the sampling frequency and pitch frequency of an input signal, it is empirically determined.

In this case, since the first and second counters COUNT1 and COUNT2 respectively hold the count values corresponding to the intervals (1) and (2), NO is obtained in step S407. As a result, the flow advances to step S408.

If noise or the like is mixed with the input voice signal, the state of NO in step S407 may last abnormally long, thus inhibiting production of a musical tone from being designated.

In order to prevent such an abnormal state, the value of the third counter COUNT3 for counting the time corresponding to the pitch period of a voice signal is always monitored to check whether the count value exceeds a predetermined limit value LIMIT much larger than the pitch period of the lowest tone of the voice signal (step S408).

This limit value is also determined empirically, similar to the above-mentioned tolerance range. If, for example, the sampling frequency is 20 kHz and the minimum extraction tone pitch (pitch) is 110.5 Hz (corresponding to note name "A1"), since $$200000 \div 110.5 = 180.995 \ldots$$

the limit value is set to be about 180.

If YES in step S408, i.e., an abnormal state occurs, the flow advances to step S314 in FIG. 3A to designate muting of all the currently produced sounds and clear the variable ON NOW. Thereafter, the flow returns to step S301, and the above-described pitch extraction processing is executed again.

If NO in step S408, the flow advances to step S409 to clear the value of the second counter COUNT2 and restore the status flag STATUS FLAG to "2". Subsequently, the process of obtaining the next zero-crossing point is started. In this case, the value held as the variable PIT COUNTER is invalidated, whereas the third counter COUNT3 is kept operated, and the first counter COUNT1 keeps holding the count value corresponding to the interval (1).

After the state of STATUS FLAG=2 is restored, the flow of processing advances to the states of STATUS FLAG=3 and STATUS FLAG=4, so that the count value corresponding to the interval (3) in FIG. 2 is held in the second counter COUNT2, and the count value corresponding to the interval ((6) in FIG. 2) between the start point of the interval (1) and the zero-crossing point Z5 of the interval (3) is held as the variable PIT COUNTER.

Similar to the above case, since the COUNT1 value (corresponding to the duration of the interval (1)) does not coincide with the COUNT2 value (corresponding to the duration of the interval (3)), NO is obtained in step S407. As a result, the flow advances to step S409 through step S408, and the processing is repeated from the state of STATUS FLAG=2.

When the status flag STATUS FLAG is set at "4" again, the second counter COUNT2 is holding the count value corresponding to the interval (4) in FIG. 2, while the count value corresponding to the interval (7) is held as the variable PIT COUNTER. In step S407, YES is obtained for the first time, and the flow advances to step S410.

In this case, the correct pitch frequency of the input waveform is the value of the third counter COUNT3 (corresponding to the interval (7) in FIG. 2) held as the variable PIT COUNTER. A note number corresponding to this value is read out from the table in the ROM 9 shown in FIG. 1 to be set as the variable PIT (step S410).

In the next step, the status flag STATUS FLAG and all the counters are cleared to be reset to their initial states (step S411).

Subsequently, the flow advances to steps S307 to S309 for the note-ON/OFF processing, in which sound production designation is made with respect to a musical tone having the note number corresponding to the pitch (tone pitch) of the input voice signal.

More specifically, if YES is obtained in step S604 of the flow chart in FIG. 5 corresponding to step S309, and it is determined in step S605 that no sound is currently produced (YES), sound production designation corresponding to the variable PIT indicating the note number is performed in step S608. If it is determined in step S605 that a sound is currently produced (NO), the variable ON NOW indicating the note number of the currently produced tone is compared with the variable PIT indicating the note number corresponding to the extracted pitch. If the two values coincide with each other, since it means that the tone need not be produced again, the flow returns to the main routine (FIGS. 3A and 3B). If they do not coincide with each other, since it means that the note number of a note to be produced is changed, muting of the currently produced sound is designated with respect to the sound source 5 (step S607). In step S608, sound production designation corresponding to the variable PIT stored as a new note number is performed.

After the sound production designation, the flow advances to steps S307 to S302 and to step S304, and the same operation as described above is repeated from the state of STATUS FLAG=0.

In the above-described embodiment, the durations of the intervals of waveform elements on the positive side (e.g., the waveform elements a, b, c, d, . . . in FIG. 2) in relation to the zero-amplitude reference level are compared with each other to extract a pitch. The present invention is not limited to this. The same pitch extracting operation as described above can be performed by using waveform elements on the negative side.

In addition, the above-described operations using waveform elements on the positive and negative sides in relation to the reference level may be concurrently performed so that if the values of the respective third counters COUNTER3 are nearly equal with each other within a predetermined tolerance range, the average value of, e.g., the two counters COUNT3 is obtained as the pitch frequency of the input waveform, thereby performing pitch extraction with higher precision.

In the note-ON/OFF processing shown in FIG. 5, if the pitch of a currently produced musical tone changes, sound production processing is performed again after the musical tone is muted. However, in this case, if, for example, the envelope does not change so much, the sound source 5 in FIG. 2 may be designated such that only the tone pitch is changed without muting the musical tone.

According to the above-described arrangement, the pitch of an input waveform can be stably extracted, regardless of the influence of harmonic components, by extracting a point of time at which it is determined that a given interval between zero-crossing points has substantially the same duration as another interval between zero-crossing points, and waveform elements corresponding to the two intervals are similar to each other.

With this operation, a pitch indicating the tone pitch of an audio sound waveform, e.g., a singing voice or a musical tone containing harmonic components, can be reliably extracted.

Second Embodiment

Outline of embodiment

The second embodiment of the present invention will be described next. This embodiment has the same arrangement as that of the first embodiment.

The second embodiment includes the process of obtaining the areas of waveform elements (a, b, c, d, . . . in FIG. 2) as an additional characteristic feature with respect to the first embodiment.

More specifically, referring to FIG. 2, until the interval ④ is detected, an accumulated A/D-converted amplitude value corresponding to the area of the waveform element a is written, as a variable SUM1, in a RAM 4, while accumulated A/D-converted amplitude values corresponding to the areas of the waveform elements b, c, and d are sequentially written as a variable SUM2 in the RAM 4.

When the interval ④ having substantially the same duration as that of the interval ① is detected, and it is determined that the accumulated amplitude values written as the SUM1 and the SUM2 corresponding to the areas of the waveform elements a and d in the two intervals ① and ④, the duration ⑦ between zero-crossing points of the intervals ① and ④ is set as a pitch frequency.

Operation of embodiment

Figure 6A:
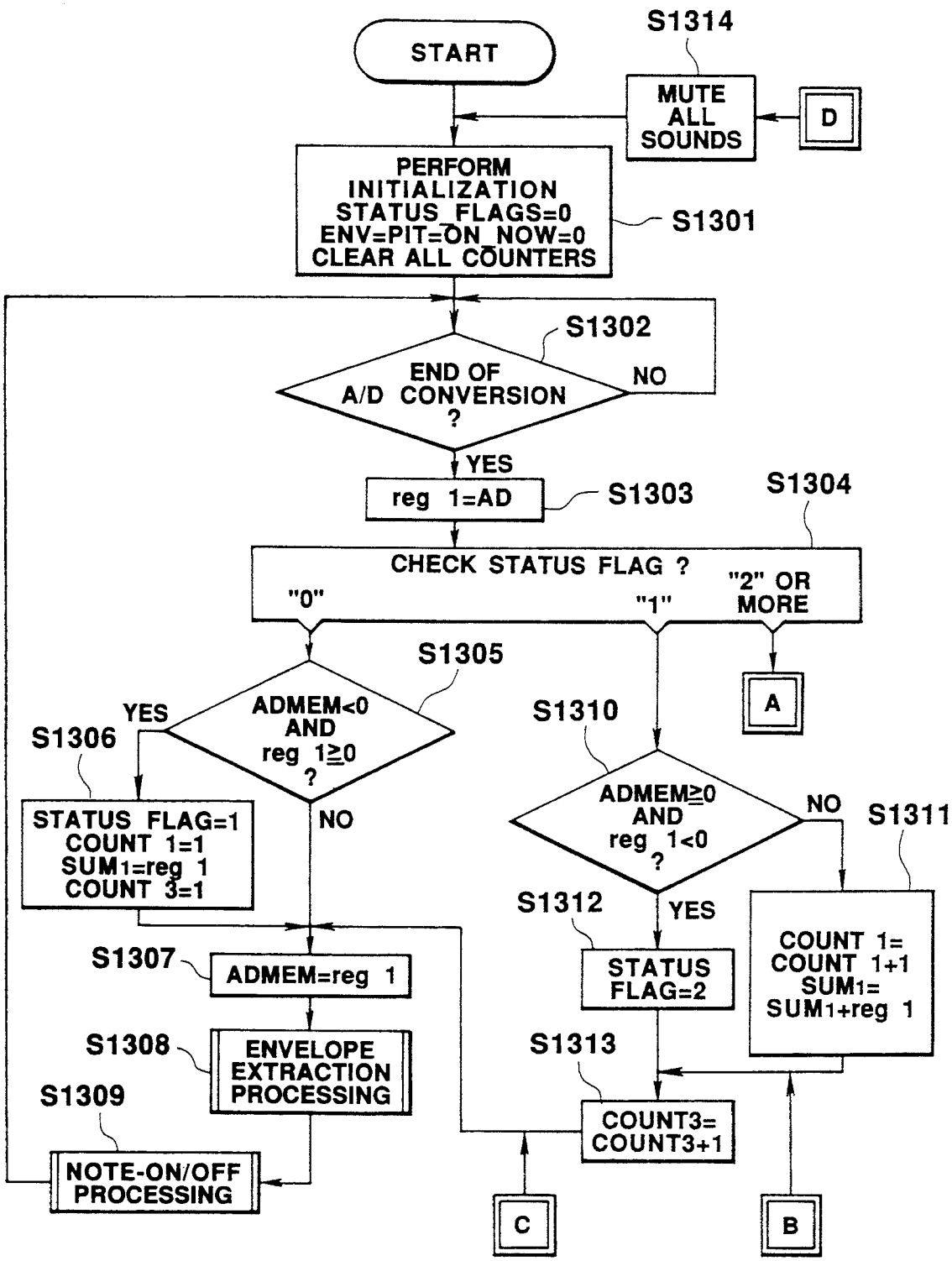
FIGS. 6A and 6B are flow charts showing a series of operations of CPU in the second embodiment of the present invention.
Figure 6B:
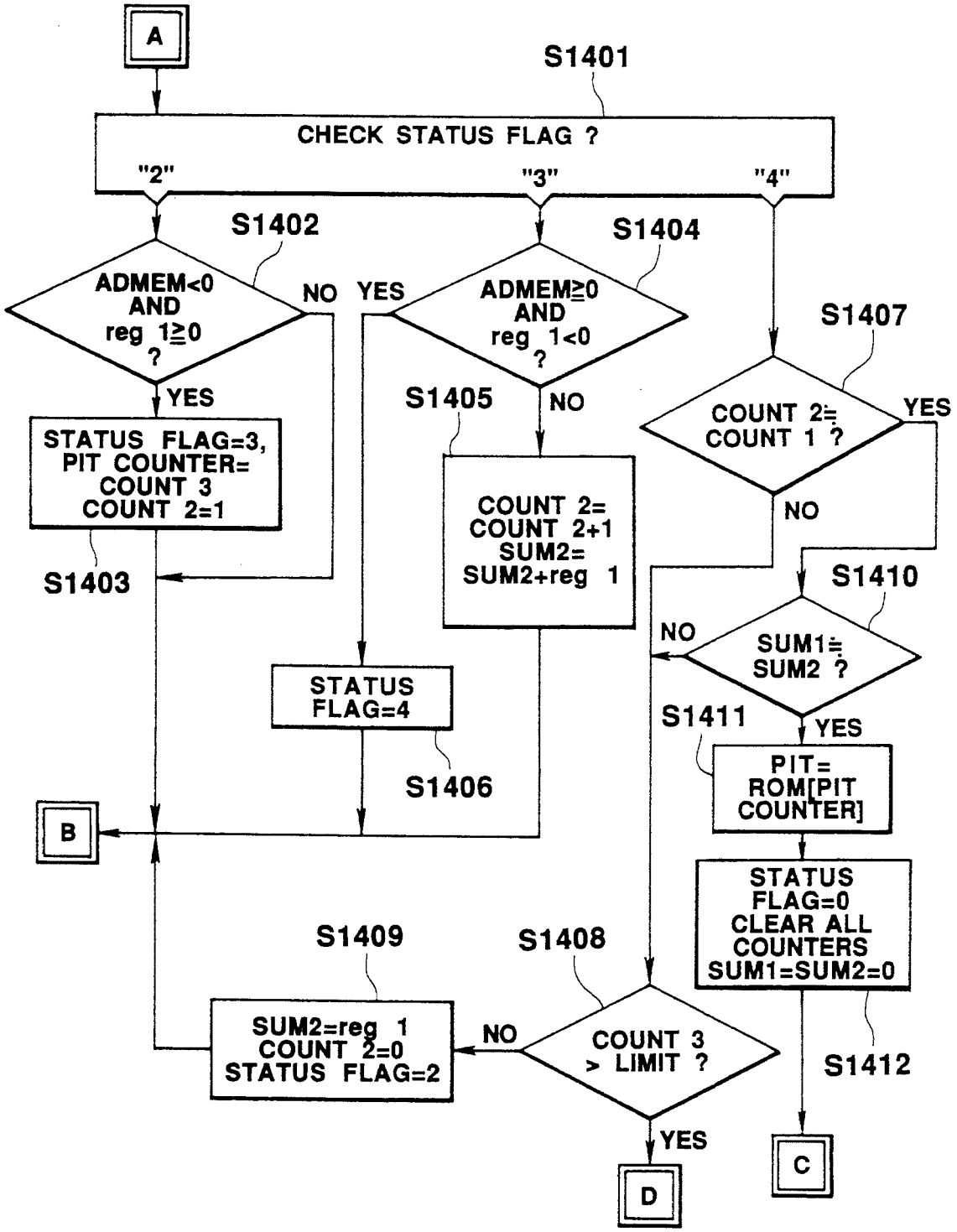

FIGS. 6A and 6B show an operation of a CPU, which is substantially the same as that (CPU3) of the first embodiment described with reference to FIGS. 3A and 3B. Of the flow charts of the CPU, portions different from the first embodiment will be mainly described.

When the input waveform reaches the zero-crossing point Z1 in FIG. 2, YES is obtained in step S1305 in FIG. 6A, and a status flag STATUS FLAG is set at "1" (step S1306). In this case, a count value COUNT1 corresponding to the duration of the interval ① in FIG. 2 and a count value COUNT3 corresponding to the duration ⑤, ⑥, or ⑦ are set to be "1" as initial values. In addition, in order to obtain the accumulated A/D-converted amplitude value of the input waveform during a count-up operation of the count value COUNT1, the value of a register reg1 corresponding to the current A/D-converted value is written as the variable SUM1.

Subsequently, the same operation as described above is performed, and the flow returns to step S1304. At this time, since the status flag STATUS FLAG=1 is set, the flow advances to step S1310.

If NO in step S1310, the value of the first counter COUNT1 is incremented by one, and the value of the register reg1 in which a new A/D-converted value of the input waveform is stored is added to the variable SUM1 (step S1311). In addition, the value of the third counter COUNT3 is incremented by one (step S1313).

Subsequently, loop processing of (steps) S1310 →S1311 →S1313 →S1307 →S1308 →S1309 →S1302 →S1303 →S1304 →S1310, . . . is repeated, and the first and third counters COUNT1 and COUNT3 are incremented by one every time the loop processing is repeated.

If YES is obtained in step 1310, and the input waveform reaches the zero-crossing point Z2 through which the waveform extends from the positive side to the negative side, the status flag STATUS FLAG is set at "2" (step S1312). Thereafter, the flow advances to step S1313 to increment the value of the third counter COUNT3. The flow then advances to steps S1307, S1308, and S1309 and returns to step S1302.

With the above-described loop processing, the count value corresponding to the duration of the interval ① in FIG. 2 is held in the first counter COUNT1, and the accumulated A/D-converted value corresponding to the area of the waveform element a is held as the variable SUM1.

Since the status flag STATUS FLAG is set at "2" in step S1312, the flow advances from steps S1302, S1303, and S1304 to steps S1401 and S1402 in FIG. 6B.

While NO is obtained in step S1402, loop processing of (steps) S1402 →S1313 (FIG. 6A) →S1307, . . . →S1309 →S1302, . . . →S1304 →S1401 (FIG. 6B) →S1402, . . . is repeated, and the count value of the third counter COUNT3 is incremented by one every time the loop processing is repeated (step S1313).

If YES is obtained in step S1402, and the input waveform reaches the zero-crossing point z3 through which the waveform extends from the negative side to the positive side, the status flag STATUS FLAG is set at "3", and the COUNT3 value (corresponding to the duration ⑤ in FIG. 2) is stored as a variable PIT COUNTER (step S1403). The variable PIT COUNTER is held as a period candidate corresponding to a pitch to be extracted, i.e., a value which may become the count value corresponding to the interval ⑦ in FIG. 2. In addition, the value of the second counter COUNT2 is set to be "1".

Subsequently, the flow advances to the following steps: S1403 →S1313 (FIG. 6A), . . . →S1309 →S1302, . . . →S1304 →S1401 (FIG. 6B).

Since the status flag STATUS FLAG=3 is set at this time, the flow advances from step S1401 to step S1404. In this case, in order to detect a zero-crossing point through which the input waveform extends from the positive side to the negative side, i.e., the zero-crossing point Z4 corresponding to the end point of the interval ② in FIG. 2 it is checked whether the value of a variable ADEM (the A/D-converted one sampling operation ahead of the current A/D-converted value) is positive, and the value of the register reg1 (the current A/D-converted value) is negative (step S1404).

While NO is obtained in step S1404, loop processing of (steps) S1404 →S1405 →S1313 (FIG. 6A), . . . →S1309 →S1302, . . . →S1304 →S1401 (FIG. 6B) →S1404 is repeated, and the value of the second counter COUNT2 is incremented by one every time the processing in step S1405 is performed in the repetitive loop processing. In addition, the A/D-converted value stored in the register reg1 is added to the variable SUM2. With this operation, the duration of the interval ② and the area (the accumulated A/D-converted value) of the waveform element b of the input waveform in FIG. 2 can be obtained. In addition, the value of the third is cleared. Thereafter, the flow returns to step S1301 to start the above-described pitch extraction processing again.

If NO in step S1408, the flow advances to step S1409 to clear the value of the second counter COUNT2 and restore the status flag STATUS FLAG to "2". Subsequently, the process of obtaining the next zero-crossing point is started again. At this time, although the value held as the variable PIT COUNTER is invalidated, the third counter COUNT3 is kept counted up, and the first counter COUNT1 holds the count value corresponding to the interval ① in FIG. 2.

After the status flag STATUS FLAG is restored to "2" in the above-described manner, the flow of processing advances to the states of STATUS FLAG=3 and STATUS FLAG=4, so that the count value corresponding to the interval ③ in FIG. 2 is held in the second counter COUNT2, and the count value corresponding to the interval (⑥ in FIG. 2) between the start point of the interval ① and the zero-crossing point Z5 of the interval ③ is held as the variable PIT COUNTER. In addition, the accumulated A/D-converted value written as the variable SUM2 is cleared, and each A/D-converted value of the waveform element c in the register reg1 is sequentially added to the variable SUM2.

Similar to the above case, in this case, since the COUNT1 value (corresponding to the duration of the counter COUNT3 is incremented by one every time the loop processing is repeated (step S1313).

If YES in step S1404, it means that the zero-crossing point Z4 is detected, and the status flag STATUS FLAG is changed to "4" (step S1406). Thereafter, the flow advances to step S1313 in FIG. 6A to increment the value of the third counter COUNT3 by one. The flow then advances to the following steps: S1307 →S1308 →S1309, . . . →S1401 (FIG. 6B).

Since the status flag STATUS FLAG=4 is set at this time, the flow advances from step S1401 to step S1407. In this state, the intervals ②, ③, and ④ are sequentially compared with the interval (1) in FIG. 2. When the interval ④ having substantially the same duration as that of the interval ① is detected, the variables SUM1 and SUM2 as the accumulated A/D-converted value, of the input waveform, equivalent to the areas of the waveform elements corresponding to the intervals ① and ④ are compared with each other. If it is determined that the two values are equal or almost equal to each other, the process of setting the duration of the ⑦ in FIG. 2 as the pitch period of the input waveform is performed.

If YES in step S1408, i.e., if an abnormal state occurs, the flow advances to step S1314 in FIG. 6A to instruct a sound source 5 in FIG. 1 to mute all the currently produced sounds. In addition, a variable ON NOW interval ① and the COUNT2 value (corresponding to the duration of the interval ③) are not almost equal to each other, NO is obtained in step S1407. As a result, the flow advances to step S1409 through step S1408 to start the processing from the state of STATUS FLAG=2 again.

When the status flag STATUS FLAG is set at "4", the second counter COUNT2 holds the count value corresponding to the interval ④, whereas the variable PIT COUNTER is held as the count value corresponding to the interval ⑦. In step S1407, YES is obtained for the first time, and the flow advances to step S1410.

In step S1410, it is further checked whether the accumulated A/D-converted value corresponding to the area of the waveform element a, held as the variable SUM1, substantially coincides with the accumulated A/D-converted value corresponding to the area of the waveform element d, held as the variable SUM2.

If NO is obtained in step S1410, it means that the waveform corresponding to the correct pitch period is not obtained. As a result, the flow advances to step S1408 to start the processing from the state of STATUS FLAG=2 so as to search for a new waveform.

If YES is obtained in step S1410, it means that the waveform corresponding to the correct pitch period is obtained. As a result, the flow advances to step S1411.

In this case, the correct value of the pitch period of the input waveform corresponds to the value (corresponding to the interval (7) in FIG. 2), of the third counter COUNT3, held as the variable PIT COUNTER. A note number corresponding to this value is read out from a table in a ROM 9 in FIG. 1 and is set as a variable PIT (step S1410).

After this operation, the contents of the status flag STATUS FLAG, all the counters, and variables SUM1 and SUM2 are cleared to perform initialization (step S1412).

Subsequently, the flow advances to steps S1307 to S1309 for the note-ON/OFF processing in FIG. 6A, in which sound production designation is performed to produce a new musical tone having the note number corresponding to the pitch (tone pitch) of the input voice signal described above.

In the above-described embodiment, the durations of the intervals and the areas of waveform elements on the positive side (e.g., the waveform elements a, b, c, d, . . . in FIG. 2) in relation to the zero-amplitude reference level are compared with each other together with the comparison between the corresponding accumulated A/D-converted values, thereby performing pitch extraction. The present invention is not limited to this. The same pitch extracting operation as described above can be performed by using waveform elements on the negative side.

In addition, the above-described operations using waveform elements on the positive and negative sides in relation to the reference level may be concurrently performed so that if the values of the respective third counters COUNTER3 are nearly equal to each other within a predetermined tolerance range, the average value of, e.g., the two counters COUNT3 is obtained as the pitch frequency of the input waveform, thereby performing pitch extraction with higher precision.

According to the above-described arrangement, the pitch of an input waveform can be stably extracted, regardless of the influence of harmonic components, by extracting a point of time at which it is determined that a given interval between zero-crossing points has substantially the same duration as another interval between zero-crossing points, and waveform elements corresponding to the two intervals are similar to each other. In this case, since accumulated amplitude values corresponding to the areas of waveform elements are used as determination factors in addition to the intervals between zero-crossing points, more accurate pitch extraction can be performed.

With this operation, a pitch indicating the tone pitch of an audio sound waveform, e.g., a singing voice or a musical tone containing harmonic components, can be reliably extracted.

Third Embodiment

Outline of embodiment

The third embodiment of the present invention will be described below. This embodiment has the same arrangement as that of the first or second embodiment.

The third embodiment includes the process of obtaining peak values or the largest (maximum) amplitude values (Pa, Pb, Pc, Pd, . . . in FIG. 7) of waveform elements as an additional characteristic feature with respect to the first embodiment.

Figure 7:
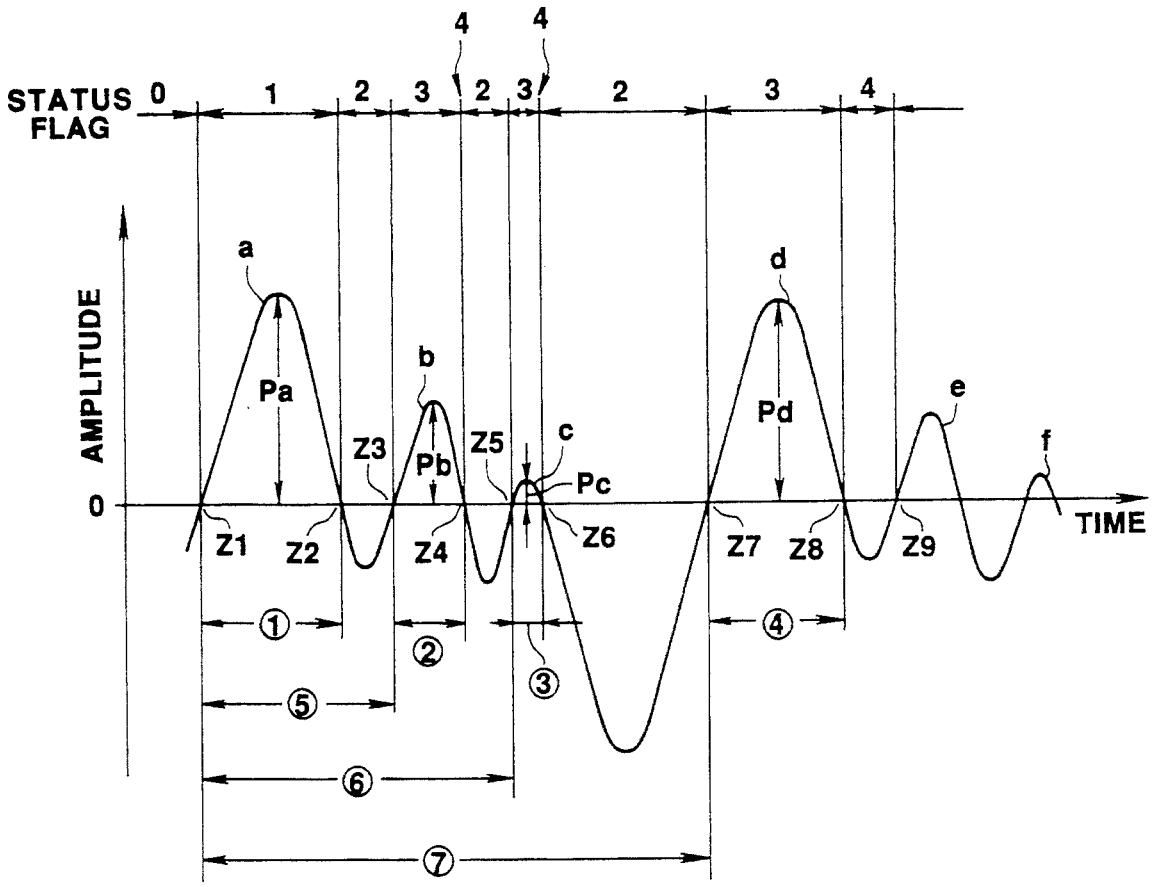
FIG. 7 is a graph showing the waveform of an input waveform signal to explain the third embodiment of the present invention.

More specifically, referring to FIG. 7, until an interval (4) is detected, the maximum value Pa of the amplitudes of a waveform element a is written as a variable MAX1 in a RAM 4, whereas the maximum values Pb, Pc, and Pd of the amplitudes of waveform elements b, c, and d are sequentially written as a variable MAX2 in the RAM 4.

When the interval (4) having substantially the same duration as that of an interval (1) is detected, and it is determined that the maximum amplitude values Pa and Pd of the waveform elements a and d of the two intervals (1) and (4) are almost equal to each other, a duration (7) between zero-crossing points Z1 and Z7 of the intervals (1) and (4) is set as a pitch frequency.

Operation of embodiment

Figure 8A:
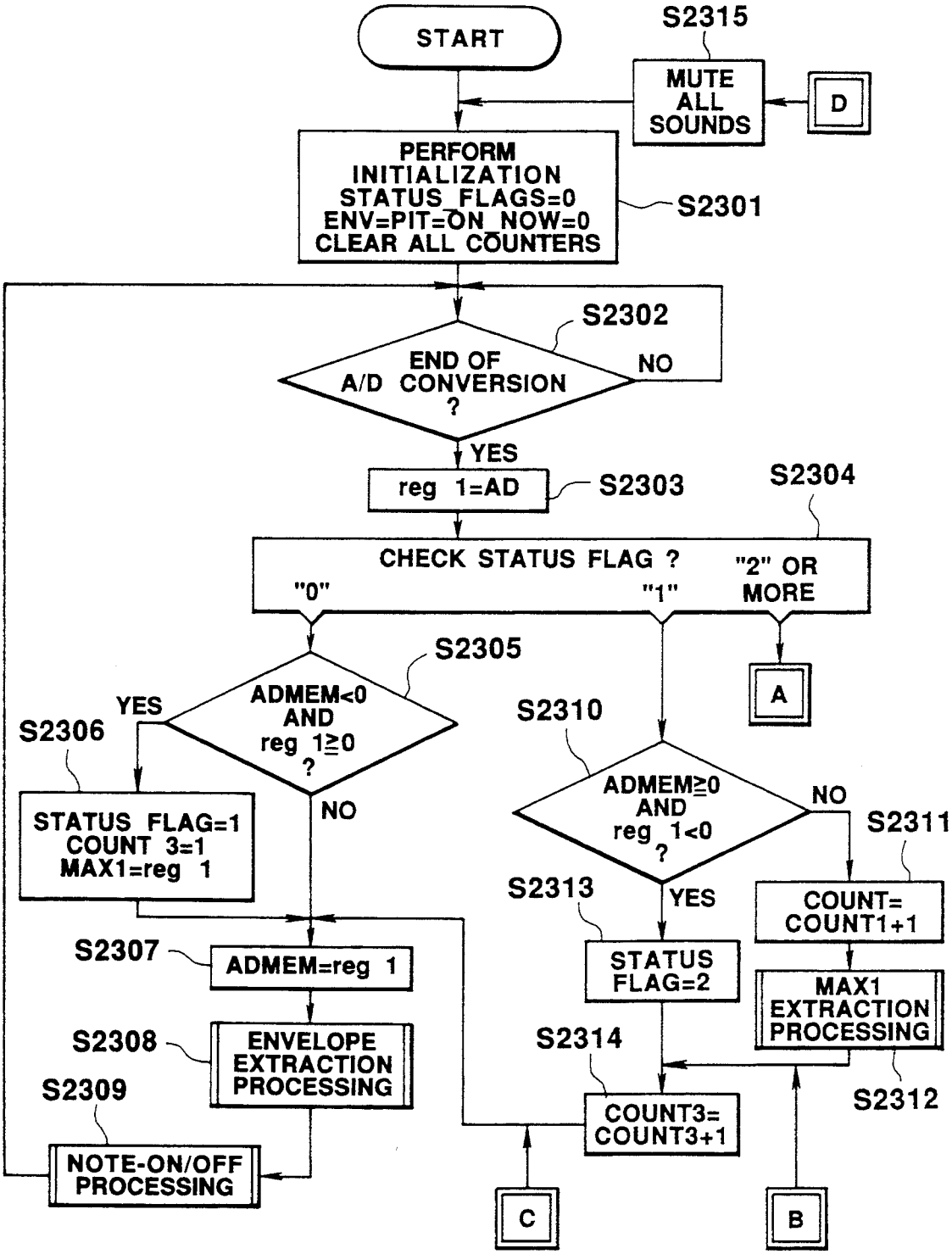
FIGS. 8A and 8B are flow charts showing a series of operations of a CPU in the third embodiment.
Figure 8B:
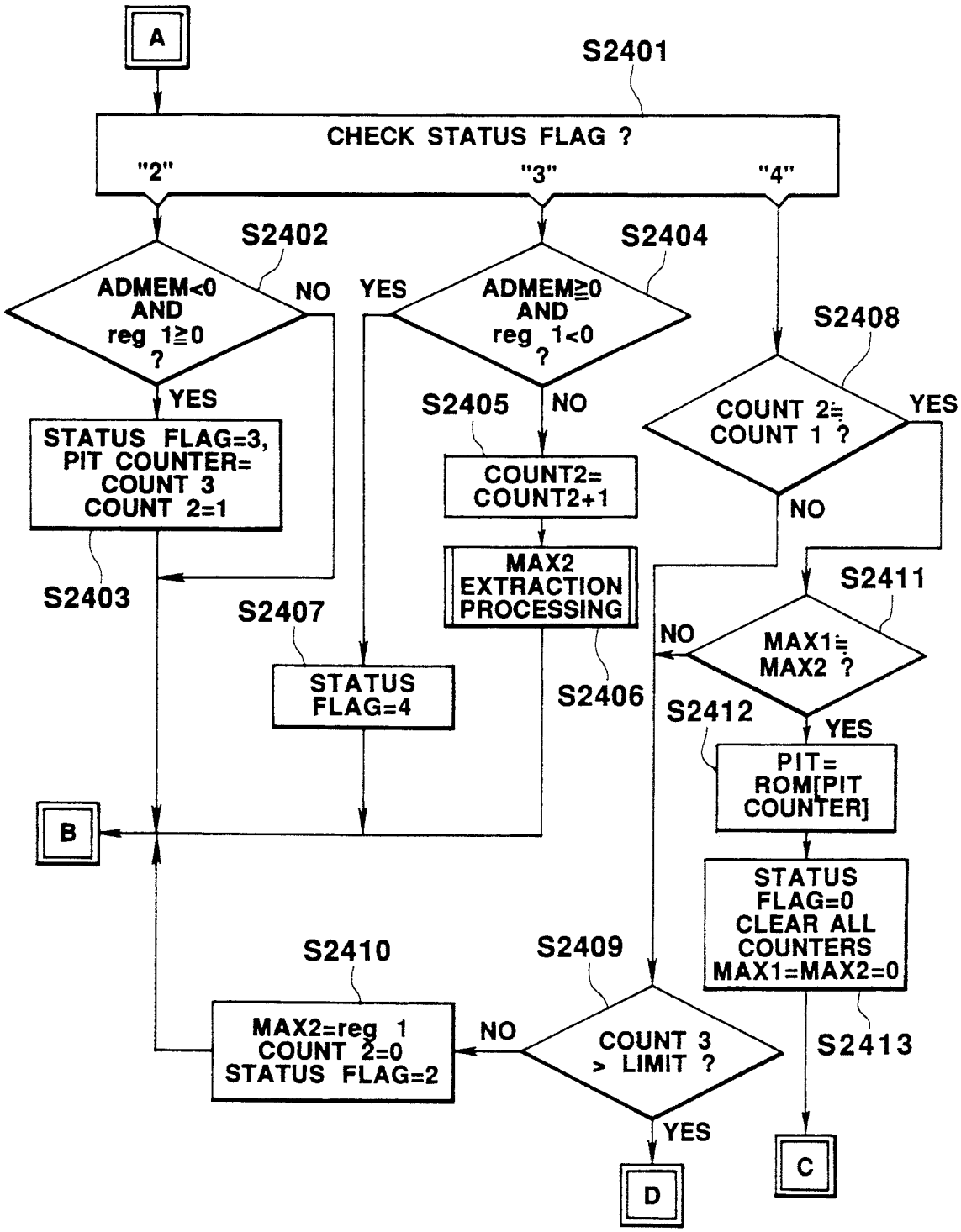
Figure 9A:
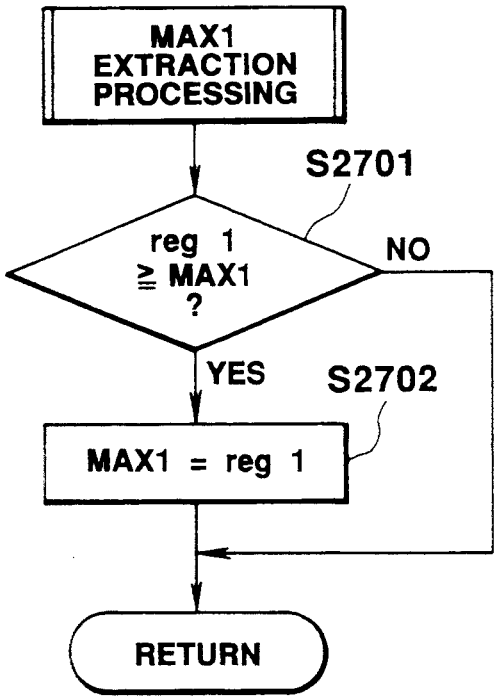
FIGS. 9A and 9B are flow charts showing a detailed routine of detecting the maximum value of an input waveform, of the operations of the CPU.
Figure 9B:
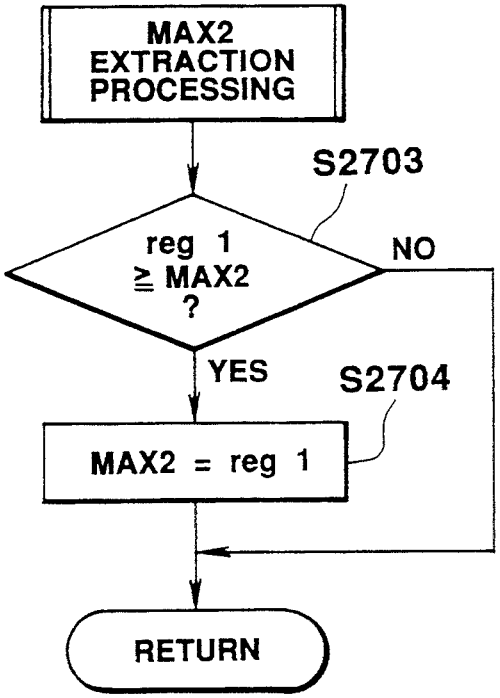

FIGS. 8A and 8B show an operation of a CPU corresponding to that 3 FIG. 1. FIGS. 9A and 9B are flow charts showing parts of the operation in detail. The overall operation is substantially the same as that of the first embodiment described with reference to FIGS. 3A and 3B. Of the flow charts of the CPU, portions different from the first embodiment will be mainly described.

When the input waveform reaches the zero-crossing point Z1 in FIG. 7, YES is obtained in step S2305 of FIG. 8A, and a status flag STATUS FLAG is set at "1" (step S2306). At this time, a count value COUNT1 equivalent to the duration of the interval (1) and a count value COUNT3 equivalent to a duration (5), (6), or (7) are set to be "1" as initial values. In addition, in order to obtain the maximum amplitude value of the input waveform during a count-up operation for the count value COUNT1, the value of a register reg1 corresponding to the current A/D-converted value is written as the variable MAX1.

Subsequently, the same operation as described above is performed, and the flow returns to step S2304. At this time, since the status flag STATUS FLAG = 1 is set, the flow advances to step S2310. In this state, in order to count the duration of the interval (1) in FIG. 7, an increment operation of the variable COUNT1 as the first counter (to be referred to as the first counter COUNT1 hereinafter) is started. In addition, in order to count the duration of the interval (7), an increment operation of the variable COUNT3 as the third counter (to be referred to as the third counter COUNT3 hereinafter) is started.

In step S2310, in order to detect a zero-crossing point through which the input waveform extends from the positive side to the negative side, i.e., a zero-crossing point Z2 as the end point of the interval (1) in FIG. 7, it is checked whether the value of a variable ADMEM written as an A/D-converted one sampling operation ahead of the current A/D-converted value is positive, and the value of the register reg1 in which the current A/D-converted value is written is negative.

If NO in step S2310, the value of the first counter COUNT1 is incremented by one (step S2311), and the flow advances to the maximum value detection routine (step S2312) shown in FIG. 9A.

Referring to FIG. 9A, it is checked whether the current input value of the register reg1 is equal to or larger than the variable MAX1 (step S2701). If YES in step S2701, the current input value is set as the MAX1 (step S2702). If NO in step S2701, no processing is performed, and the flow returns to the routine shown in FIG. 8A. In this manner, the maximum value of A/D-converted values is obtained as the variable MAX1.

After the processing in step S2312 described above, the flow advances to step S2314 to increment the value of the third counter COUNT3 by one.

Subsequently, loop processing of (steps) S2310 →S2311 →S2312 →S2314 →S2307 →S2308 →S2302, . . . S2304 →S2310, . . . is repeated, and the first and second counters COUNT1 and COUNT3 are incremented by one every time the loop processing is repeated.

If YES is obtained in step S2310, and the input waveform reaches the zero-crossing point Z2 through which the waveform extends from the positive side to the negative side, the status flag STATUS FLAG is set at "2" (step S2312). Thereafter, the flow advances to step S2314 to increment the value of the third counter COUNT 3 by one. The flow advances to the following steps: S2307 →S2308 →S2309. The flow then returns to step S2302.

With the above-described loop processing, the count value corresponding to the duration of the interval ① in FIG. 7 is held in the first counter COUNT1, while the maximum amplitude value of the waveform element a is held as the variable MAX1.

Since the status flag STATUS FLAG is set at "2" in step S2312, the flow advances from steps S2302, S2303, and S2304 to steps S2401 and S2402 in FIG. 8B.

In step S2402, in order to detect a zero-crossing point (Z3 in FIG. 7) through which the input waveform extends from the negative side to the positive side, the same processing as that in step S2305 in FIG. 8A is performed, i.e., it is checked whether the value of the ADMEM (the A/D-converted value one sampling operation ahead of the current A/D-converted) is negative, and the value of the register reg1 (the current A/D-converted value) is positive.

While NO is obtained in step S2402, loop processing of (steps) S2402 →S2314 (FIG. 8A)→S2307 S2309 →S2302, . . . →S2304 →S2401 →(FIG. 8B) →S2402, . . . is repeated, and the count value of the third counter COUNT3 is incremented by one every time the loop processing is repeated (step S2314).

If YES is obtained in step S2402, and the input waveform reaches the zero-crossing point Z3 through which the waveform extends from the negative side to the positive side, the status flag STATUS FLAG is set at "3", and the COUNT3 value (corresponding to the duration ⑤ in FIG. 7) is stored as a variable PIT COUNTER (step S2403). This variable PIT COUNTER is held as a period candidate corresponding to a pitch to be extracted, i.e., a value which may become the count value corresponding to the interval ⑦. An increment operation is then started to increment a variable COUNT2 as the second counter one by one.

Thereafter, the flow advances to the following steps: S2403 →S2314 (FIG. 8A), . . . →S2309 →S2302, . . . →S2304 →S2401 (FIG. 8B).

Since the status flag STATUS FLAG=3 is set this time, the flow advances from step S2401 to step S2404. In this state, with the same processing as that in the state of STATUS FLAG=1, the second counter COUNT2 is incremented, and the maximum value of the input waveform is obtained as the variable MAX2.

In step S2404, in order to detect a zero-crossing point through which the input waveform extends from the positive side to the negative side, i.e., a zero-crossing point Z4 corresponding to the end point of an interval ② in FIG. 7, it is checked whether the value of the variable ADEM (the A/D-converted value one sampling operation ahead of the current A/D-converted value) is positive, and the value of the register reg1 (the current A/D-converted value) is negative (step S2404).

While NO is obtained in step S2404, loop processing of (steps) S2404 →S2405, . . . →S2406 →S2314 (FIG. 8A), . . . →S2309 →S2302, . . . →S2304 →S2401 (FIG. 8B) →S2404, and the second counter COUNT2 is incremented by one every time the processing in step S2405 is performed in the repetitive loop processing. In addition, in step S2406, the maximum A/D-converted value is obtained as the variable MAX2.

The routine for obtaining the maximum value as the variable MAX2 is similar to the processing in the state of STATUS FLAG=1 and is shown in step S2703 and the subsequent steps in FIG. 9B. In this routine, it is checked whether the current input value of the register reg1 is equal to or larger than the variable MAX2 (step S2703). If YES in step S2703, the current input value is set as the variable MAX2 (step S2704). If NO in step S2703, no processing is performed, and the flow returns to the routine shown in FIG. 8B. In this manner, the maximum A/D-converted value is obtained as the variable MAX2.

With the above-described processing, the duration of the interval ② and the maximum value Pb of the waveform element b in FIG. 7 can be obtained.

Note that the value of the third counter COUNT3 is also incremented by one every time the above-described operation is repeated.

If YES in step S2404, it means that the zero-crossing point Z4 is detected, and the status flag STATUS FLAG is changed to at "4" (step S2407). Subsequently, the flow advances to step S2314 in FIG. 8A to increment the third counter COUNT3 by one. The flow then advances to the following steps: S2307 →S2308 →S2309, . . . →S2401 (FIG. 8B).

Since the status flag STATUS FLAG=4 is set this time, the flow advances from step S2401 to step S2408. In this state, the intervals ②, ③, ④ and are sequentially compared with the interval ① in FIG. 7. When the interval ④ having almost the same duration as that of the interval ① is detected, the variables MAX1 and MAX2 as the maximum A/D-converted values of the waveform elements a and d of the two intervals ① and ④ are further compared with each other. If it is determined that these values are substantially equal to each other, the process of setting the duration of the interval it ⑦ in FIG. 7 as the pitch period of the input waveform is performed.

If YES is obtained in step S2409, i.e., if an abnormal state occurs, the flow advances to step S2315 in FIG. 8A to instruct a sound source 5 in FIG. 1 to mute all the currently produced sounds. In addition, a variable ON NOW is cleared. Subsequently, the flow returns to step S2301 to execute the above-described pitch extraction processing again.

If NO in step S2409, the flow advances to step S2410 to set the current value of the register reg1 as the variable MAX2. In addition, the value of the second counter COUNT2 is cleared, and the status flag STATUS FLAG is restored to "2" . The process of obtaining the next zero-crossing point is started again. At this time, although the value held as the variable PIT COUNTER is invalidated, the third counter COUNT3 is kept operated, and the first counter COUNT1 holds the count value corresponding to the interval ① in FIG. 7.

After the status flag STATUS FLAG is restored to "2" in this manner, similar to the above case, the flow of processing advances to the states of STATUS FLAG=3 and STATUS FLAG=4, so that the count value corresponding to the interval ③ in FIG. 7 is held in the second counter COUNT2, while the count value (corresponding to the interval ③ in FIG. 7) corresponding to the interval between the start point of the interval ⑥ in FIG. 7 and a zero-crossing point Z5 is held as the variable PIT COUNTER. In addition, the maximum A/D-converted value written as the variable MAX2 is cleared, and the maximum value of the waveform element c is newly obtained.

Similar to the above case, since the COUNT1 value (corresponding to the duration of the interval ①) and the COUNT2 value (corresponding to the duration of the interval ③) do not coincide with each other, NO is obtained in step S2408. As a result, the flow advances to step S2410 through step S2409 to start the processing from the state of STATUS FLAG=2 again.

When the status flag STATUS FLAG is set at "4" again, the count value corresponding to the interval ④ in FIG. 7 is held in the second counter COUNT2, while the count value corresponding to the interval ⑦ in FIG. 7 is held as the variable PIT COUNTER. In step S2408, YES is obtained for the first time. The flow then advances to step S2411.

In step S2411, it is further checked whether the maximum A/D-converted value, of the waveform element a, held as the variable MAX1 substantially coincides with the maximum A/D-converted value, of the waveform element d, held as the variable MAX2.

If NO in step S2411, it is determined that the waveform corresponding to the correct pitch period is not obtained. As a result, the flow advances to step S2409 to start the processing from the state of STATUS FLAG=2 so as to search for a new waveform.

If YES in step S2411, it is determined that the waveform corresponding to the correct pitch period is obtained. The flow then advances to step S2412.

In this case, the correct value of the pitch period of the input waveform corresponds to the value of the third counter COUNT3 (corresponding to the interval ⑦ in FIG. 7) held as the variable PIT COUNTER. A note number corresponding to this value is read out from a table in a ROM 9 in FIG. 1 and is set as a variable PIT (step S2412).

Subsequently, the contents of the status flag STATUS FLAG, all the counters, and the variable MAX1 and MAX2 are cleared to perform initialization (step S2413).

After this operation, the flow advances to steps S2307 to S2309 for the note-ON/OFF processing in FIG. 8A, in which sound production designation is performed to produce a new musical tone having the note number corresponding to the pitch (tone pitch) of the input voice signal.

In the above-described embodiment, the durations of the intervals of waveform elements on the positive side (e.g., the waveform elements a, b, c, d, . . . in FIG. 7) in relation to the zero-amplitude reference level are compared with each other together with the comparison between the corresponding maximum A/D-converted values, thereby performing pitch extraction. The present invention is not limited to this. The same pitch extracting operation as described above can be performed by using waveform elements on the negative side.

In addition, the above-described operations using waveform elements on the positive and negative sides in relation to the reference level may be concurrently performed so that if the values of the respective third counters COUNTER3 are nearly equal to each other within a predetermined tolerance range, the average value of, e.g., the two counters COUNT3 is obtained as the pitch frequency of the input waveform, thereby performing pitch extraction with higher precision.

According to the above-described arrangement, the pitch of an input waveform can be stably extracted, regardless of the influence of harmonic components, by extracting a point of time at which it is determined that a given interval between zero-crossing points has almost the same duration as another interval between zero-crossing points, and waveform elements corresponding to the two intervals are similar to each other. In this case, since maximum amplitude values corresponding to the peak values of waveform elements are used as determination factors in addition to the intervals between zero-crossing points, more accurate pitch extraction can be performed.

With this operation, a pitch indicating the tone pitch of an audio sound waveform, e.g., a singing voice or a musical tone containing harmonic components, can be reliably extracted.

The preferred embodiments of the present invention have been described. However, the above embodiments are merely examples, the present invention can adopt various other arrangements, and all the modifications and applications of the present invention fall within this range. Therefore, the scope of the present invention should be determined by only the appended claims and their equivalents.

What is claimed is:

1. A pitch extracting apparatus comprising:

first interval measuring means for measuring an interval, as a first interval, between a zero-crossing point, at which an input waveform changes from a negative or positive first polarity to a second polarity, and a next zero-crossing point at which the input waveform changes from the second polarity to the first polarity;

second interval measuring means for, after measurement by said first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity;

third interval measuring means for sequentially measuring intervals from the zero-crossing point at which measurement by said first interval measuring means is started;

interval storage means for sequentially updating and storing the intervals, as period data, which are measured by said third interval measuring means at the respective points of time at which said second interval measuring means starts measuring the respective second intervals;

determining means for sequentially checking whether the first interval measured by said first interval measuring means is nearly equal to the respective second intervals sequentially measured by said second interval measuring means within a predetermined tolerance range; and repetitive control means for outputting the period data stored in said interval storage means as pitch data of the input waveform at a point of time at which said determining means detects an equality where the measured first interval is nearly equal to said respective measured second intervals, and for sequentially extracting pitch data from the input data by sequentially repeating each processing from the measurement by said first interval measuring means.

2. An apparatus according to claim 1, further comprising control means for checking whether the interval measured by said third interval measuring means exceeds an interval corresponding to a pitch period of a predetermined lowest tone at a point of time at which the equality is not detected by said determining means, and for repeating each processing from the measurement by said first interval measuring means if it is determined that the interval exceeds the pitch period.

3. A pitch extracting apparatus comprising:

first interval measuring means for measuring an interval, as a first interval, between a zero-crossing point, at which an input waveform changes from a negative or positive first polarity to a second polarity, and a next zero-crossing point at which the input waveform changes from the second polarity to the first polarity;

first accumulated amplitude value measuring means for measuring an accumulated value of absolute amplitude values of the input waveform, as a first accumulated amplitude value, which said first interval measuring means is measuring the first interval;

second interval measuring means for, after measurement by said first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity;

second accumulated amplitude value measuring means for sequentially measuring an accumulated value of absolute amplitude values of the input waveform, as a second accumulated amplitude value, in the respective intervals in which said second interval measuring means sequentially measures the respective second intervals;

third interval measuring means for sequentially measuring intervals from the zero-crossing point at which measurement by said first interval measuring means is started;

interval storage means for sequentially updating and storing the intervals, as period data, which are measured by said third interval measuring means at the respective points of time at which said second interval measuring means starts measuring the respective second intervals;

determining means for sequentially checking whether the first interval measured by said first interval measuring means is nearly equal to the respective second intervals sequentially measured by said second interval measuring means within a predetermined tolerance range, and for sequentially checking whether the first accumulated amplitude value measured by said first accumulated amplitude value measuring means is nearly equal to the respective sound accumulated amplitude values sequentially measured by said second accumulated amplitude value measuring means within a predetermined tolerance range; and repetitive control means for outputting the period data stored in said interval storage means as pitch data of the input waveform at a point of time at which said determining means detects an equality, representing that the first interval is nearly equal to one of the second intervals and that the first accumulated amplitude value is nearly equal to one of the second accumulated amplitude values and for sequentially extracting pitch data from the input data by sequentially repeating each processing from the measurement by said first interval measuring means.

4. An apparatus according to claim 3, further comprising control means for checking whether the interval measured by said third interval measuring means exceeds an interval corresponding to a pitch period of a predetermined lowest tone at a point of time at which the equality is not detected by said determining means, and for repeating each processing from the measurement by said first interval measuring means if it is determined that the interval exceeds the pitch period.

5. A pitch extracting apparatus comprising:

first interval measuring means for measuring an interval, as a first interval, between a zero-crossing point, at which an input waveform changes from a negative or positive first polarity to a second polarity, and a next zero-crossing point at which the input waveform changes from the second polarity to the first polarity;

first maximum amplitude value measuring means for measuring a maximum amplitude value of the input waveform, as a first maximum amplitude value, while said first interval measuring means is measuring the first interval;

second interval measuring means for, after measurement by said first interval measuring means is completed, sequentially measuring each interval, as a second interval, between each zero-crossing point, at which the input waveform changes from the first polarity to the second polarity, and a corresponding next zero-crossing point at which the input waveform changes from the second polarity to the first polarity;

second maximum amplitude value measuring means for sequentially measuring a maximum value of absolute amplitude values of the input waveform, as a second maximum amplitude value, in the respective intervals in which said second interval measuring means sequentially measures the respective second intervals;

third interval measuring means for sequentially measuring intervals from the zero-crossing point at which measurement by said first interval measuring means is started;

interval storage means for sequentially updating and storing the intervals, as period data, which are measured by said third interval measuring means at the respective points of time at which said second interval measuring means starts measuring the respective second intervals;

determining means for sequentially checking whether the first interval measured by said first interval measuring means is nearly equal to the respective second intervals sequentially measured by said second interval measuring means within a predetermined tolerance range, and for sequentially checking whether the first maximum amplitude value measured by said first maximum amplitude value measuring means is nearly equal to the respective second maximum amplitude values sequentially measured by said second maximum amplitude value measuring means within a predetermined tolerance range; and repetitive control means for outputting the period data stored in said interval storage means as pitch data of the input waveform at a point of time at which said determining detects an equality representing that the first interval is nearly equal to one of the second intervals and that the first maximum amplitude value is nearly equal to one of the second maximum amplitude values, and for sequentially extracting pitch data from the input data by sequentially repeating each processing from the measurement by said first interval measuring means.

6. An apparatus according to claim 5, further comprising control means for checking whether the interval measured by said third interval measuring means exceeds an interval corresponding to a pitch period of a predetermined lowest tone at a point of time at which the equality is not detected by said determining means, and for repeating each processing from the measurement by said first interval measuring means if it is determined that the interval exceeds the pitch period.

7. A pitch extracting apparatus comprising:

means for receiving an input waveform signal;

measuring means for measuring time intervals between zero-crossing points of said input waveform signal;

detecting means for sequentially obtaining time intervals, of the time intervals between a plurality of zero-crossing points sequentially measured by said measuring means, which are defined by zero-crossing points having a first characteristic and next adjacent zero-crossing points having a second characteristic, and for detecting substantial coincidence between two time intervals;

pitch data output means for, when the substantial coincidence is detected by said detecting means, outputting a time interval between the zero-crossing points having the first characteristic and belonging to the two time intervals between which the substantial coincidence is detected, as pitch data;

waveform area calculating means for obtaining areas of waveform elements between consecutive zero-crossing points of the input waveform signal; and waveform area coincidence detecting means for, when said detecting means sequentially obtains time intervals between zero-crossing points having the first characteristic and next adjacent zero-crossing points having the second characteristic, and detects substantial coincidence between two time intervals, detecting substantial coincidence between corresponding waveform areas obtained by said waveform area calculating means, and wherein said pitch data output means comprises means for, only when said waveform area coincident detecting means detects the substantial coincidence between the corresponding waveform areas, outputting a time interval between the zero-crossing points having the first characteristic and belonging to the two time intervals between which the coincidence is detected, as pitch data.

8. A pitch extracting apparatus comprising:

means for receiving an input waveform signal;

measuring means for measuring time intervals between zero-crossing points of said input waveform signal;

detecting means for sequentially obtaining time intervals, of the time intervals between a plurality of zero-crossing points sequentially measured by said measuring means, which are defined by zero-crossing points having a first characteristic and next adjacent zero-crossing points having a second characteristic, and for detecting substantial coincidence between two time intervals;

pitch data output means for, when the substantial coincidence is detected by said detecting means, outputting a time interval between the zero-crossing points having the first characteristic and belonging to the two time intervals between which the substantial coincidence is detected, as pitch data;

waveform maximum value calculating means for obtaining maximum amplitude values of waveform elements between consecutive zero-crossing points of the input waveform signal; and waveform maximum value coincidence detecting means for, when said detecting means sequentially obtains time intervals between zero-crossing points having the first characteristic and next adjacent zero-crossing points having the second characteristic, and detects substantial coincidence between two time intervals, detecting substantial coincidence between corresponding maximum amplitude values of waveform elements obtained by said waveform maximum value calculating means, and wherein said pitch data output means comprises means for, only when said waveform maximum value coincidence detecting means detects the substantial coincidence between the corresponding maximum values of the waveform elements, outputting a time interval between the zero-crossing points having the first characteristic and belonging to the two time intervals between which the coincidence is detected, as pitch data.

9. A pitch extracting method comprising:

a first step of measuring an interval, as a first interval, between a zero-crossing point, at which an input waveform changes from a negative or positive first polarity to a second polarity, and a next zero-crossing point at which the input waveform changes from the second polarity to the first polarity;

a second step of sequentially measuring, after measurement in said first step is completed, each interval, as a second interval, between each zero-crossing point at which the input waveform changes from the first polarity to the second polarity, and a corresponding next zero-crossing point at which the input waveform changes from the second polarity to the first polarity;

a third step of sequentially measuring intervals from the zero-crossing point at which measurement in said first step is started;

a fourth step of sequentially updating and storing the intervals, as period data, which are measured in said third step at the respective points of time at which measuring of the respective second intervals is started in said second step;

a fifth step of detecting an equality by sequentially checking whether the first interval measured in said first is nearly equal to the respective second intervals sequentially measured in said second step within a predetermined tolerance range; and a sixth step of outputting the period data stored in said fourth step as pitch data of the input waveform at a point of time at which said equality is detected in said fifth step, said equality being when said first interval is determined to be nearly equal to the respective second intervals, and the sequentially extracting pitch data from the input data by sequentially repeating each processing from the measurement in said first step.

10. A method according to claim 9, further comprising checking whether the interval measured in said third step exceeds an interval corresponding to a pitch period of a predetermined lowest tone at a point of time at which the equality is not detected said fifth step, and repeating each processing from the measurement in said first step if it is determined that the interval exceeds the pitch period.

11. A pitch extracting method comprising:

a first step of measuring an interval, as a first interval, between a zero-crossing point, at which an input waveform changes from a negative or positive first polarity to a second polarity, and a next zero-crossing point at which the input waveform changes from the second polarity to the first polarity;

measuring an accumulated value of absolute amplitude values of the input waveform, as a first accumulated amplitude value, while said first interval is being measured;

a second step of sequentially measuring, after measurement in said first step is completed, each interval, as a second interval, between each zero-crossing point, at which the input waveform changes from the first polarity to the second polarity, and a corresponding next zero-crossing point at which the input waveform changes from the second polarity to the first polarity;

sequentially measuring an accumulated value of absolute amplitude values of the input waveform, as a second accumulated amplitude value, in the respective intervals in which said second intervals are being measured in said second step;

a third step of sequentially measuring intervals from the zero-crossing point at which measurement in said first step is started;

sequentially updating and storing the intervals in an interval storage means, as period data, which are measured in said third step at the respective points of time at which said second intervals are started to be measured in said second step;

sequentially checking whether the first interval measured in said first step is nearly equal to the respective second intervals sequentially measured in said second step within a predetermined tolerance range, and sequentially checking whether the first accumulated amplitude value is nearly equal to the respective seqentially measured second accumulated amplitude values within a predetermined tolerance range; and outputting the period data stored in said interval storage means as pitch data of the input waveform at a point of time at which an equality is detected in said sequentially checking step which represents that the first interval is nearly equal to one of the second intervals and that the first accumulated amplitude value is nearly equal to one of the second accumulated amplitude values, and then sequentially extracting pitch data from the input data by sequentially repeating each processing beginning from the measurement of said first interval.

12. A method according to claim 11, further comprising checking whether the interval measured in said third step exceeds an interval corresponding to a pitch period of a predetermined lowest tone at a point of time at which the equality is not detected in said sequentially checking step, and repeating each processing beginning from the measurement of said first interval if it is determined that the interval exceeds the pitch period.

13. A pitch extracting method comprising:

a first step of measuring an interval, as a first interval, between a zero-crossing point, at which an input waveform changes from a negative or positive first polarity to a second polarity, and a next zero-crossing point at which the input waveform changes from the second polarity to the first polarity;

measuring a maximum amplitude value of the input waveform, as a first maximum amplitude value, while said first interval is being measured;

a second step of sequentially measuring, after measurement in said first step is completed, each interval, as a second interval, between each zero-crossing point, at which the input waveform changes from the first polarity to the second polarity, and a corresponding next zero-crossing point at which the input waveform changes from the second polarity to the first polarity;

sequentially measuring a maximum value of absolute amplitude values of the input waveform, as a second maximum amplitude value, in the respective intervals in which said second intervals are being measured in said second step;

a third step of sequentially measuring intervals from the zero-crossing point at which measurement in said first step is started;

sequentially updating and storing the intervals in an interval storage means, as period data, which are measured in said third step at the respective points of time at which said second intervals are started to be measured in said second step;

sequentially checking whether the first interval measured in said first step is nearly equal to the respective second intervals sequentially measured in said second step within a predetermined tolerance range, and sequentially checking whether the first maximum amplitude value is nearly equal to the respective sequentially measured second maximum amplitude values within a predetermined tolerance range; and outputting the period data stored in said interval storage means as pitch data of the input waveform at a point of time at which an equality is detected in said sequentially checking step which represents that the first interval is nearly equal to one of the second intervals and that the first maximum amplitude value is nearly equal to one of the second maximum amplitude values, and then sequentially extracting pitch data from the input data by sequentially repeating each processing beginning from the measurement of said first interval.

14. A method according to claim 13, further comprising checking whether the interval measured in said third step exceeds an interval corresponding to a pitch period of a predetermined lowest tone at a point of time at which the equality is not detected in said sequentially checking step, and for repeating each processing beginning from the measurement of said first interval if it is determined that the interval exceeds the pitch period.

15. A pitch extracting method comprising:

a step of receiving an input waveform signal;

a step of measuring time intervals between zero-crossing points of said input waveform signal;

a detecting step of sequentially obtaining time intervals, of the time intervals between a plurality of zero-crossing points sequentially measured in said measuring step, which are defined by zero-crossing points having a first characteristic and next adjacent zero-crossing points having a second characteristic, and detecting substantial coincidence between two time intervals;

a step of outputting, when the substantial coincidence is detected in said detecting step, a time interval between the zero-crossing points having the first characteristic and belonging to the two time intervals between which the coincidence is detected, as pitch data when said substantial coincidence is detected in said detecting step;

a step of obtaining areas of waveform elements between consecutive zero-crossing points of the input waveform signal; and a step of determining when said detecting step sequentially obtains time intervals between zero-crossing points having the first characteristic and next adjacent zero-crossing points having the second characteristic, and when said detecting step detects substantial coincidence between two time intervals, and thereafter detecting substantial coincidence between corresponding waveform areas obtained in said obtaining step, and wherein said outputting step further comprises outputting, only when said substantial coincidence between the corresponding waveform areas is detected in said determining step, a time interval between the zero-crossing points having the first characteristic and belonging to the two time intervals between which the coincidence is detected, as pitch data.

16. A pitch extracting method comprising:

a step of receiving an input waveform signal;

a step of measuring time intervals between zero-crossing points of said input waveform signal;

a detecting step of sequentially obtaining time intervals, of the time intervals between a plurality of zero-crossing points sequentially measured in said measuring step, which are defined by zero-crossing points having a first characteristic and next adjacent zero-crossing points having a second characteristic, and detecting substantial coincidence between two time intervals;

a step of outputting, when the substantial coincidence is detected in said detecting step, a time interval between the zero-crossing points having the first characteristic and belonging to the two time intervals between which the coincidence is detected, as pitch data when said substantial coincidence is detected in said detecting step;

a step of obtaining maximum amplitude values of waveform elements between consecutive zero-crossing points of the input waveform signal; and a step of determining when said detecting step sequentially obtains time intervals between zero-crossing points having the first characteristic and next adjacent zero-crossing points having the second characteristic, and when said detecting step detects substantial coincidence between two time intervals, and thereafter detecting substantial coincidence between corresponding maximum amplitude values of waveform elements obtained in said obtained step, and wherein said outputting step further comprises outputting, only when said substantial coincidence between the corresponding maximum values of the waveform elements is detected in said determining step, a time interval between the zero-crossing points having the first characteristic and belonging to the two time intervals between which the coincidence is detected, as pitch data.

* * * * *